US008534296B2

(12) United States Patent
Groff

(10) Patent No.: US 8,534,296 B2
(45) Date of Patent: Sep. 17, 2013

(54) SMOKING APPARATUS WITH FILTER AND COOLING

(76) Inventor: Geoffrey W. Groff, Boise, ID (US)

( * ) Notice: Subject to any disclaimer, the term of this patent is extended or adjusted under 35 U.S.C. 154(b) by 948 days.

(21) Appl. No.: 12/598,950

(22) PCT Filed: May 17, 2008

(86) PCT No.: PCT/US2008/064021

§ 371 (c)(1),
(2), (4) Date: Nov. 5, 2009

(87) PCT Pub. No.: WO2008/144595

PCT Pub. Date: Nov. 27, 2008

(65) Prior Publication Data

US 2010/0126517 A1 May 27, 2010

Related U.S. Application Data

(60) Provisional application No. 60/938,569, filed on May 17, 2007.

(51) Int. Cl.

| | |
|---|---|
| ***A24F 1/30*** | (2006.01) |
| ***A24F 1/02*** | (2006.01) |
| ***A24F 5/04*** | (2006.01) |

(52) U.S. Cl.
USPC ..... 131/215.3; 131/215.1; 131/215.2; 131/200; 131/201; 131/210

(58) Field of Classification Search
USPC ..... 131/173, 200, 201, 210, 215.1, 215.2, 131/215.3
See application file for complete search history.

(56) References Cited

U.S. PATENT DOCUMENTS

| | | | | |
|---|---|---|---|---|
| 1,513,147 | A | 10/1924 | Zahariadis | |
| 1,563,460 | A | 12/1925 | Walker | |
| 3,805,806 | A * | 4/1974 | Grihalva | 131/173 |
| 3,881,499 | A | 5/1975 | McFadden et al. | |
| 4,133,318 | A | 1/1979 | Gross et al. | |
| 4,253,475 | A * | 3/1981 | Schreiber et al. | 131/173 |
| 4,357,948 | A | 11/1982 | Schweitzer | |
| 5,738,116 | A | 4/1998 | Truelove | |
| 6,935,345 | B2 | 8/2005 | Carstens et al. | |

* cited by examiner

*Primary Examiner* — Richard Crispino
*Assistant Examiner* — Dionne Walls Mayes
(74) *Attorney, Agent, or Firm* — Your Intellectual Property Matters, LLC; Robert A. Frohwerk

(57) ABSTRACT

This apparatus for the smoking of tobacco and other bulk dried material enables those persons who enjoy smoking to do so in a healthier manner. In the described appliance a water bath cools and filters the smoke before it reaches the mouth and lungs of the smoker. An array of, preferably conical, diffusion screens (210) restricts the size of particulate matter passing through the device from the combustion bowl (180) to the user. By controlling air pressures, valves (240) in series with the diffuser (210) prevent water from flowing into it thereby minimizing the pressure a user must apply to draw smoke through the appliance. This keeps solids from accumulating on or in the diffuser which facilitates cleaning. A static turbine (300) in the throat (110) of the appliance aids additional cooling while reducing the amount of suction that must be applied by a user to clear the main chamber.

7 Claims, 20 Drawing Sheets

| |
|---|
| Fig. 6D |
| Fig. 6C |
| Fig. 6B |
| Fig. 6A |

SMOKING APPARATUS WITH FILTER AND COOLING

TECHNICAL FIELD

The present invention is an appliance used by smokers of tobacco to burn the tobacco and deliver the smoke to the user. Furthermore, the described appliance causes the smoke to pass through a liquid which cools and washes the smoke.

BACKGROUND ART

Devices commonly known as hookahs have been used for several centuries in the Mideast and oriental countries for the smoking of organic materials such as tobacco. Early hookahs were multi-stemmed pipes often made of glass. A variety of, generally dried, organic material, such as tobacco, herbal fruits and flower heads were placed in a combustion chamber or bowl and ignited. As a user would draw a vacuum on a stem of the pipe, the smoke would be drawn out of the combustion chamber, into the lungs of the user. Multiple stems allowed for multiple users to gather around the hookah to share its burning content in a social setting.

As users of hookahs grew less willing to accept the harsh high-temperature smoke produced by various substances that would irritate their lungs, a simple water bath was added to the basic pipe so that the smoke was bubbled through the water bath to remove ash and to cool and filter the smoke before it was drawn into the lungs of a user. A pipe from this subclass of hookahs became known as a "bong", a name derived from a That word that was introduced into U.S. slang by Vietnam veterans during the 1960's.

The classic bong, or water pipe, has a single, vertical, elongate open pipe about 38 mm (1½ inch) in diameter sealed at the bottom, a bowl for burning the organic substance, a single tube used for mounting the bowl and leading at an angle into the elongate pipe near its bottom. Water is placed into the elongate pipe to a level just above the junction of the open pipe and the bowl tube so that when the smoker draws on the pipe, smoke is bubbled through the water to cool and clean it. The smoke is further cooled by expansion into the wide elongate pipe. Thus the elongate pipe operates as a combined water and inhalation chamber. To clear smoke from the chamber of most common water pipes the entire bowl must be removed. Somewhat more sophisticated pipes have a small diameter hole known as a "shotgun" located in the elongate pipe just above the water level to facilitate inhaling the smoke from the chamber. This hole, if present, is kept closed by the smoker's finger during the initial stages of a smoking session. When the elongate pipe is filled with smoke, the hole is opened and the smoke is driven into the lungs with a ram effect.

Until relatively recently, artisans in the design of pipes have generally prided themselves on the simplicity of their designs, setting their articles apart from those of others by the use of decals and hand-painted adornments. The present design takes a much different approach, setting it apart from previous designs by applying significant technological advancements to the cooling and filtering functions. Only a few others are known to have applied any mechanical sophistication to advance the basic design of a water pipe.

U.S. Pat. No. 3,881,499 issued to McFadden, et al. in 1975 discloses a bong wherein there is a water chamber located above an ash trap rather than below it. An extensive set of cooling tubes are routed from the ash trap to different levels in the water chamber so that one or more of the tubes are operative depending upon the strength of the draw.

An object of U.S. Pat. No. 4,253,475 issued in 1981 to Schreiber, et al. is to provide a bong wherein the water used for cooling and cleaning the smoke is caused to flush up the inhalation chamber in order to push the smoke into the lungs of the smoker, thereby easing the drawing of smoke. This design also takes into consideration that the components of the bong are easily removed in order to facilitate cleaning.

The invention described by Grihalva in his U.S. Pat. No. 3,805,806 included a gravity-actuated one-way ball check valve assembly. This created a smoke trap to inhibit the escape of smoke from the smoke collection chamber.

DISCLOSURE OF THE INVENTION

The present invention holds appeal for those people who enjoy smoking tobacco but would prefer to do so in as healthy a manner as possible. To this end the described apparatus provides a means of filtering and cooling the smoke before it is released to enter the lungs of the smoker. The filtering system has been designed to optimize the cleaning of particulate matter from the smoke while striving to minimize the effort required by the smoker to achieve a suitable draw. Consideration is also given to ease the cleaning of the apparatus.

As a user draws on the mouthpiece of the presently described pipe, smoke is drawn through a set of micro-perforated filters. These diffusion screens trap larger particles, such as ash, but allow passage for vapors. The diffusers are covered with water which then traps components of the smoke that are not gaseous, such as tars. In order to keep water from entering the diffusion cones, a flapper is used as a check valve to prevent backwash. Other mechanisms may assist or functionally replace the flapper valve in its operation.

After the smoke has been cleaned by the diffusion screens and water bath, it fills the main tube of the pipe which serves as an inhalation chamber. At the middle of the inhalation chamber a static turbine generates a swirling motion that forms a jacket of cool incoming air around the smoke, cooling it as it is forced out of the chamber into the mouth of the user.

At the completion of a smoking session, or during an extended session, the apparatus is easily cleaned by removal of a drain plug. After draining the contaminated water bath, the pipe may be set aside for later or it may easily refilled with a small amount of water for continued use.

Additional aspects and advantages of this invention will be apparent from the following detailed description of preferred embodiments, which proceeds with reference to the accompanying drawings.

BRIEF DESCRIPTION OF DRAWINGS

The particular features and advantages of the invention briefly described above as well as other objects will become apparent from the following description taken in connection with the accompanying drawings, in which:

FIG. 9 shows the flow of air through the pipe as a user applies suction to the mouthpiece while holding the recirculation inlet hole closed;

FIG. 10 shows the flow of smoke through the pipe shortly after the user has opened the recirculation inlet hole while continuing to apply suction to the mouthpiece;

FIG. 11 shows the flow of smoke through the pipe after the system has stabilized following the opening of the recirculation inlet hole as the user continues to apply suction to the mouthpiece;

BEST MODE FOR CARRYING OUT THE INVENTION

Figure 1:
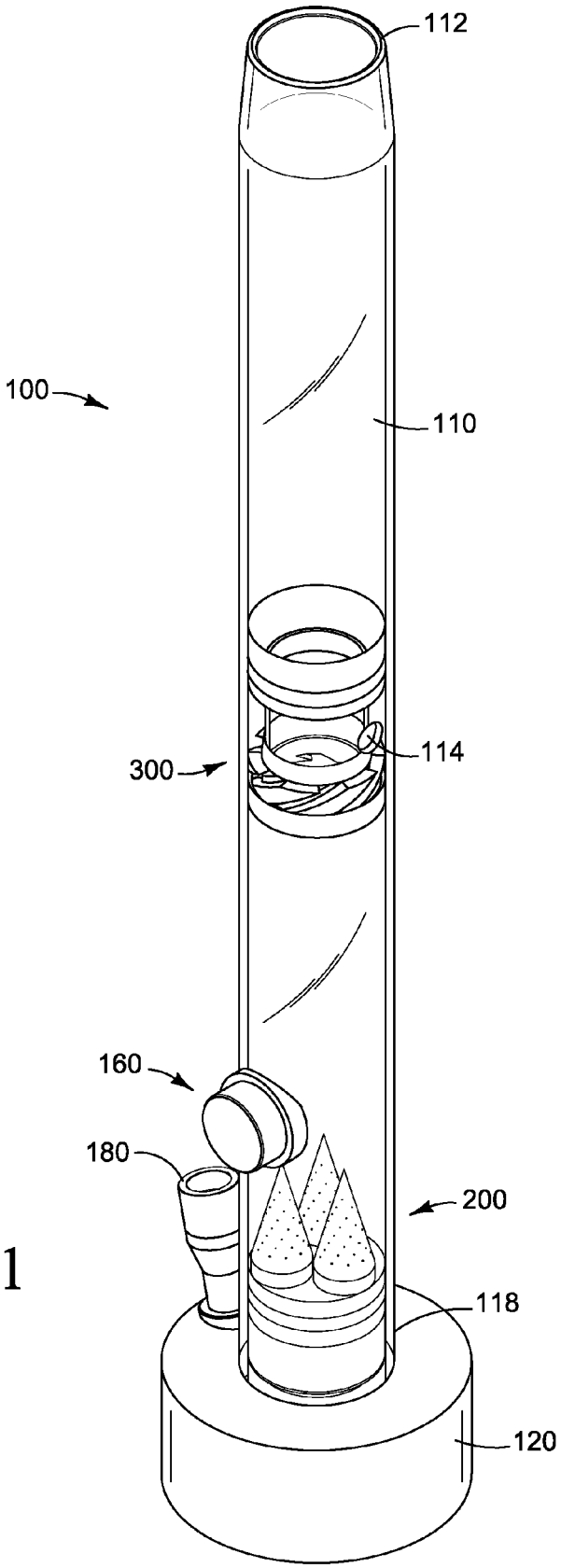
FIG. 1 shows a perspective view of the smoking apparatus.

The present invention is a filtering and cooling system used within an apparatus for the smoking of tobacco. The construction of this smoking appliance 100, as shown in FIG. 1, is based on a hollow cylindrical body tube 110 having an inner diameter of approximately 50 mm (2 inches) and an overall length of about 60 cm (24 inches). This body tube 110, generally made of glass, is rigidly mounted to a canister-like base chamber 120. Also connected into the base 120 is a tobacco combustion bowl 180 supported on a pipe stem.

The base 120 serves as a chamber for collecting the smoke from the combustion bowl 180 and channeling it through a filter system into the main body of the pipe 100. By virtue of its canister-like form factor in the preferred embodiment, the significant ratio of surface area to volume of the base 120 shown here dissipates a significant amount of the heat of combustion. This cools the smoke and increases its density. By reducing the temperature of the smoke, the likelihood of clogging subsequent filter stages is decreased. Smoke that has not been cooled will contain much higher concentrations of tar condensates which will precipitate more violently when they later encounter a cool water bath.

About one quarter of the way up the length of the body tube 110 is a drain subassembly 160 which includes a drain hole fitted with a cap or plug. Housed in the base chamber 120 so as to protrude into the base end 118 of the body tube 110 is a diffusion subassembly 200 which is the core of the presently described apparatus. In the upper half of the cylindrical body tube is a turbine subassembly 300 adjacent to a recirculation inlet 114.

Figure 2:
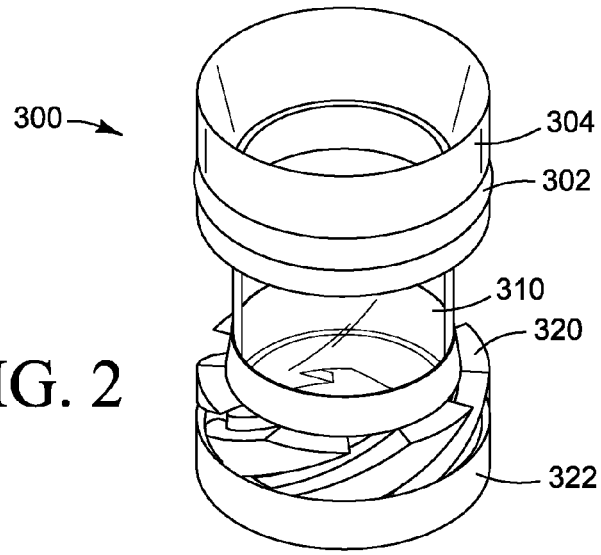
FIG. 2 is a close-up of the turbine subassembly.

A close-up detailing the components of the turbine subassembly 300 is shown in FIG. 2. This functions as a small carburetor for the mixing of air with smoke. Its operation will be described in more detail later with reference to the overall flow of air and smoke. Briefly, spiral-shaped blades surround the perimeter of a static turbine 320 which is seated on a lower carburetor ring 322. An inner tube 310 is fitted with an upper carburetor nozzle 304, and the combination is set atop the static turbine 320. In operation, a low pressure will be applied to the throat of the upper carburetor nozzle 304 which is tapered so as to create a Venturi constriction that causes the flow of air to accelerate as it passes through the inner tube 310.

Figure 3:
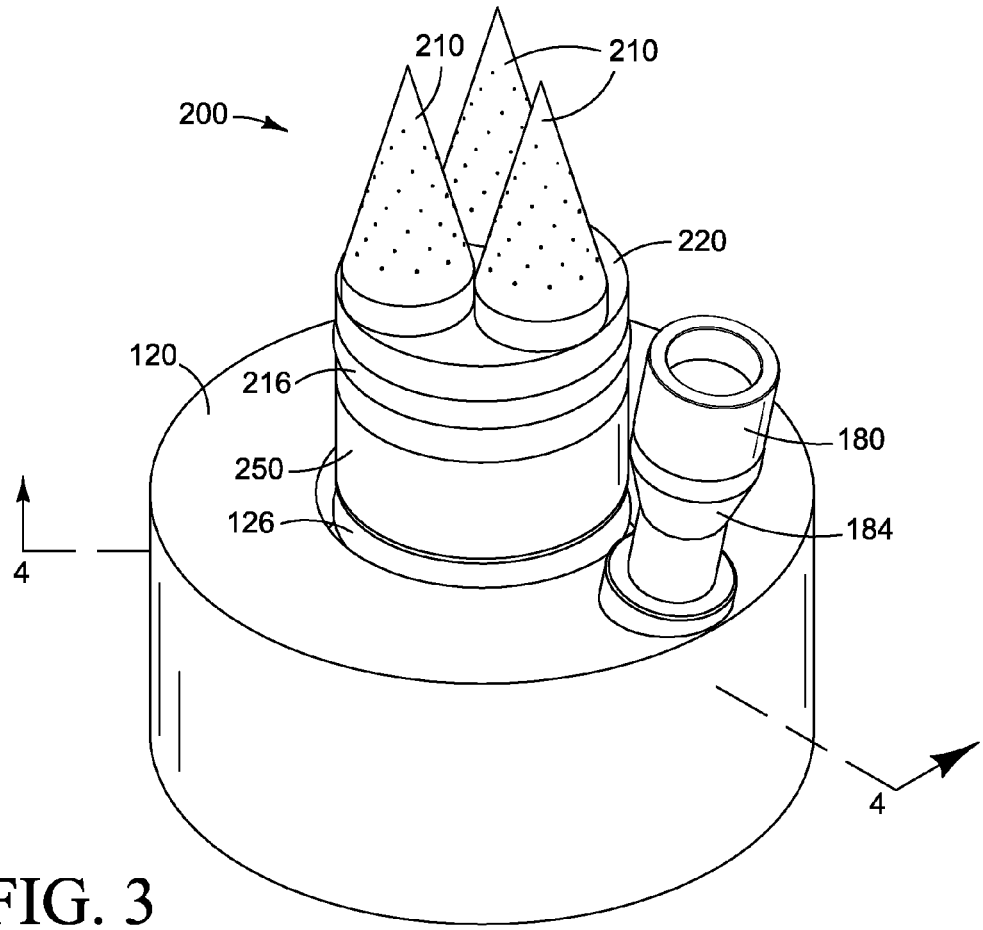
FIG. 3 is a close-up of the base assembly with diffusion subassembly.
Figure 4:
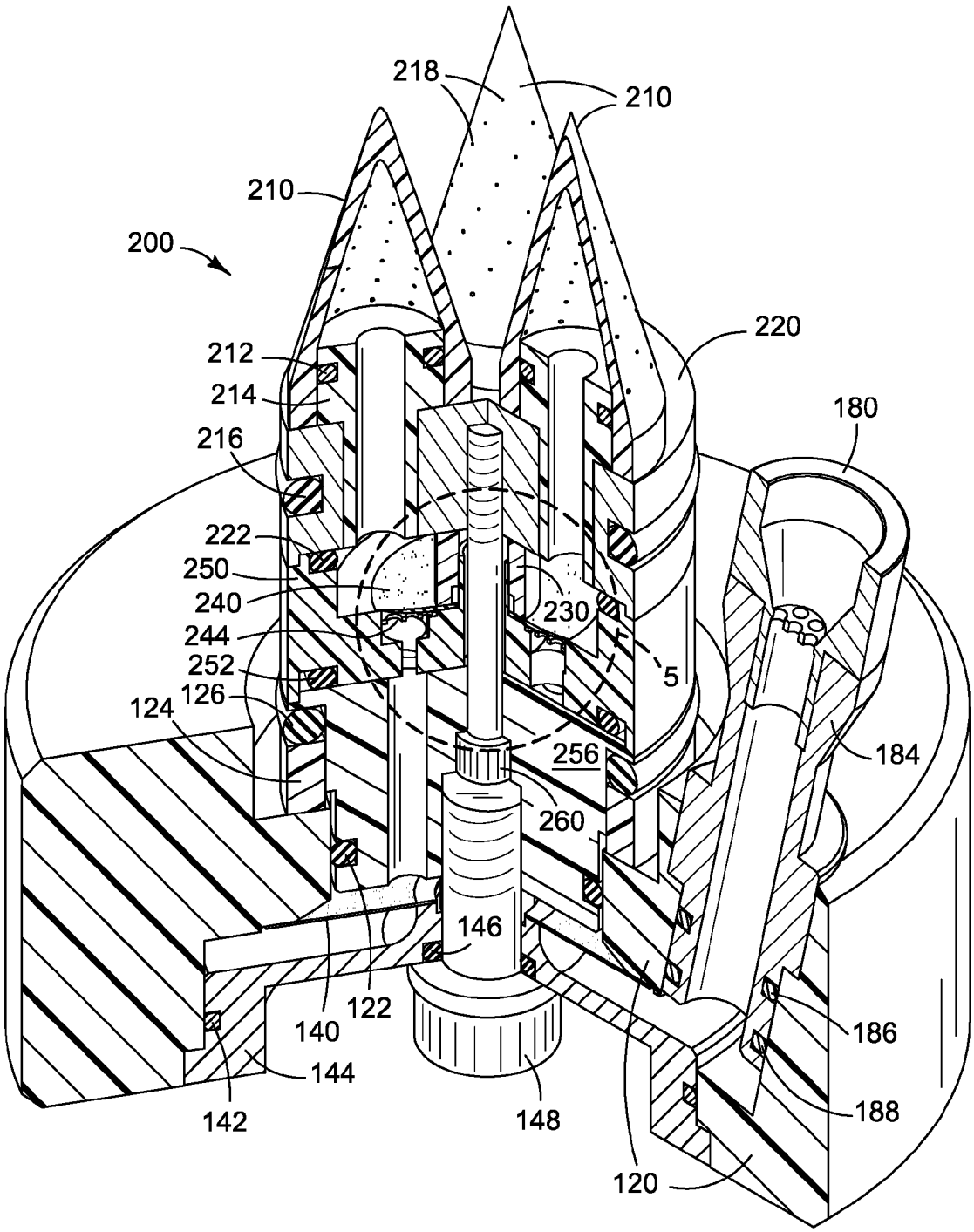
FIG. 4 shows a cutaway view of the base assembly.
Figure 5:
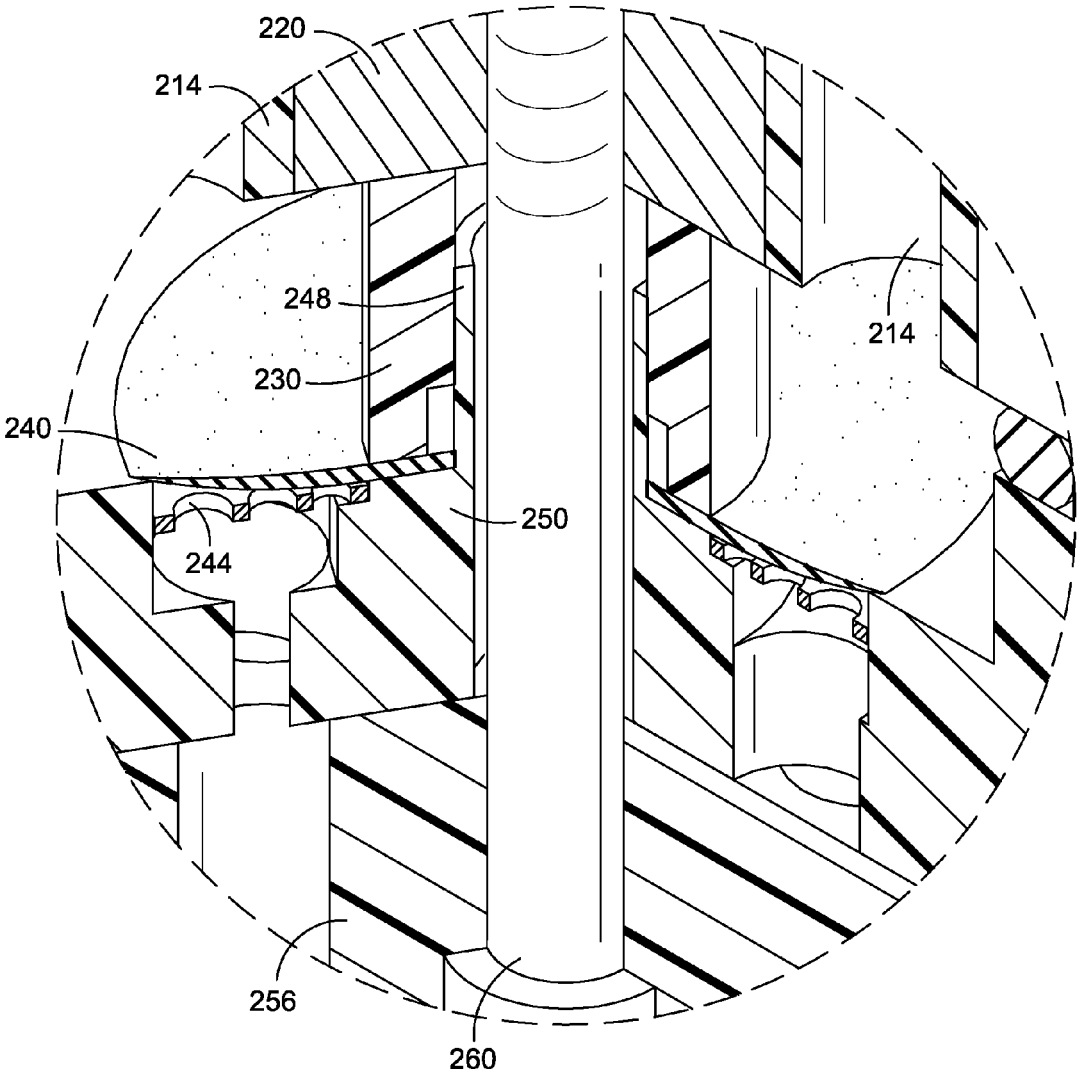
FIG. 5 is a close-up section view from FIG. 4 showing detail around the flapper valve.

The exterior of the base chamber 120 is shown in the close-up view of FIG. 3, while a cutaway view of the interior construction of the base chamber 120 appears in FIG. 4. A detailed close-up of the workings of the flapper valve 240, which resides within the base chamber 120 near the center of diffusion subassembly 200 (of FIG. 4) is offered in FIG. 5. The operation of these components will be described in more detail later with reference to the overall flow of air and smoke. FIGS. 6A-6D are exploded partial views showing the components of the preferred embodiment of the apparatus being presently described. These figures will be useful in understanding the overall operation of the disclosed pipe 100.

Figures 6, 6A:
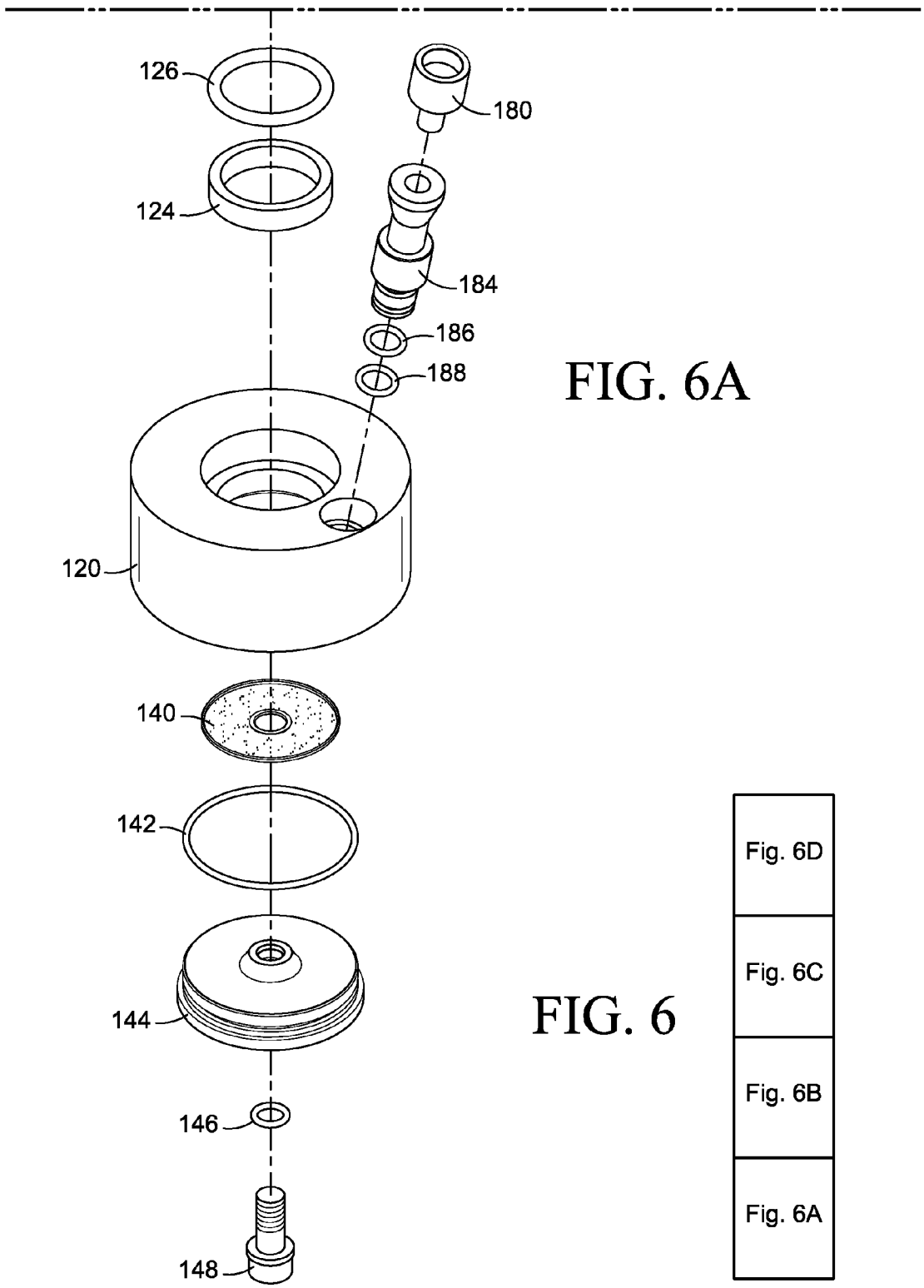
FIGS. 6A-6D depict an exploded view of the components of the entire apparatus beginning with FIG. 6A at the bottom and working upward to the top which is shown in FIG. 6D.
Figure 6B:
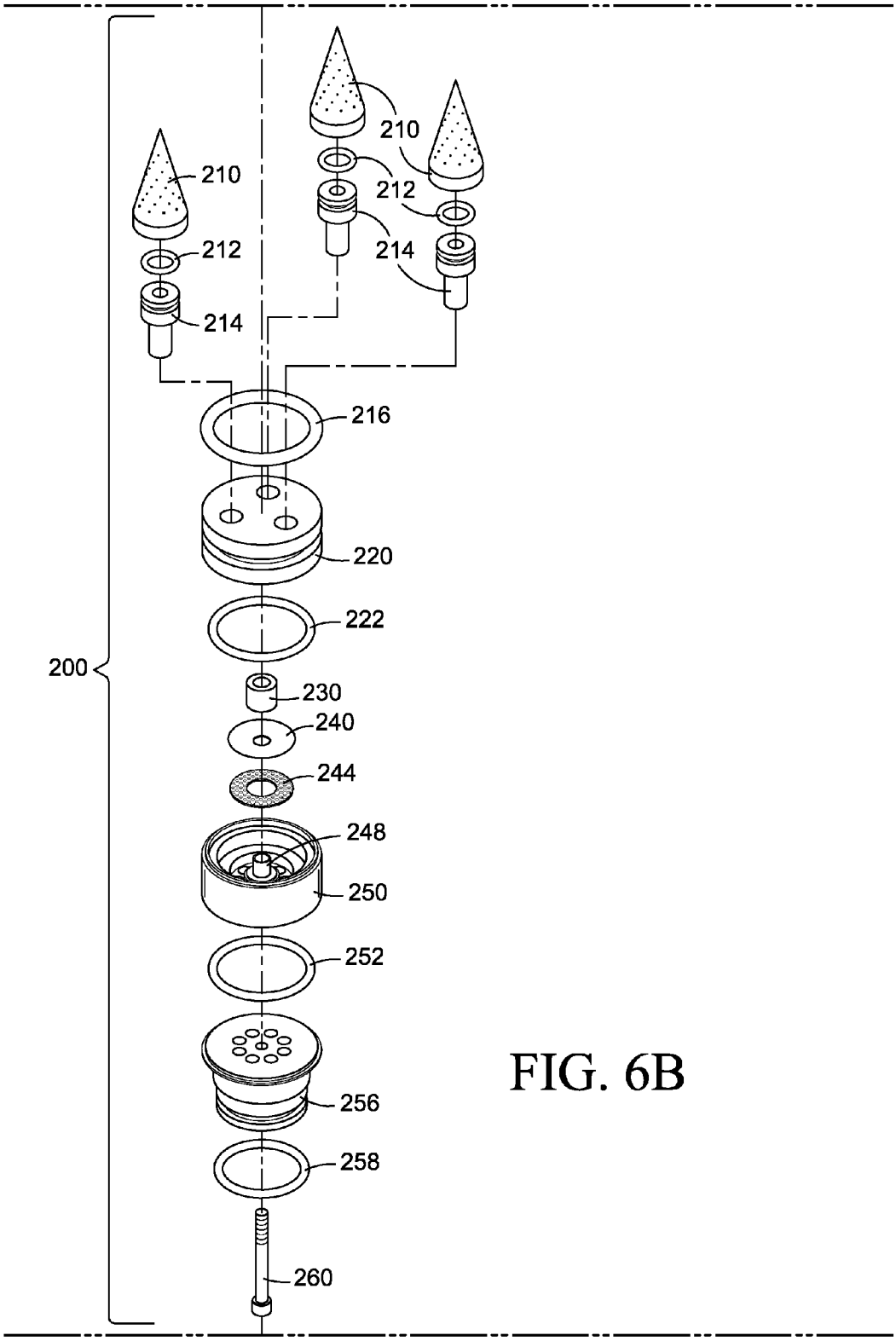
Figure 6C:
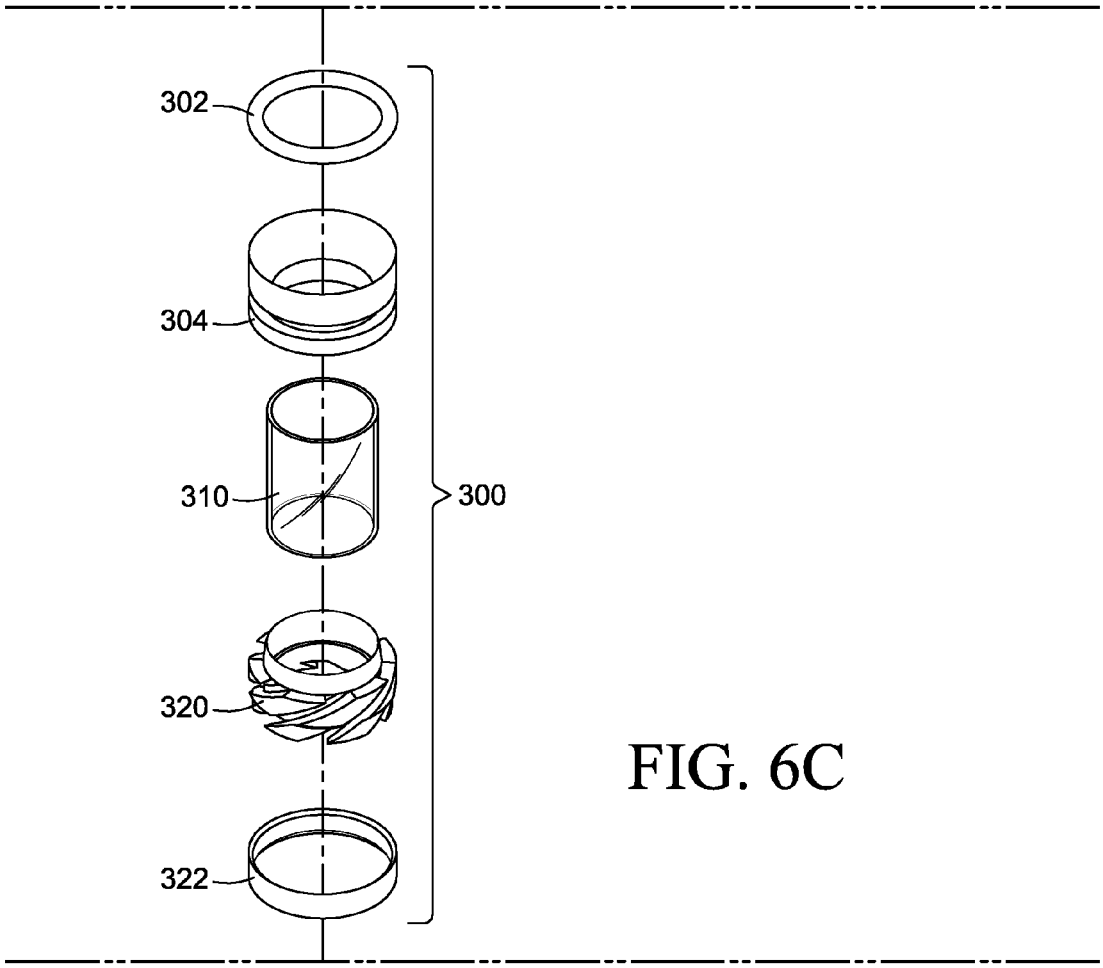

For an understanding of the diffusion subassembly 200, it will be useful to refer to FIG. 4 in conjunction with FIG. 6B. The diffusion subassembly 200 comprises one or more air diffusion cones 210 positioned in a series combination with a flapper valve 240. As seen in FIG. 1 the diffusion subassembly 200 is located at the base of the body tube 110 where it will be at least partially covered by water.

Figure 7:
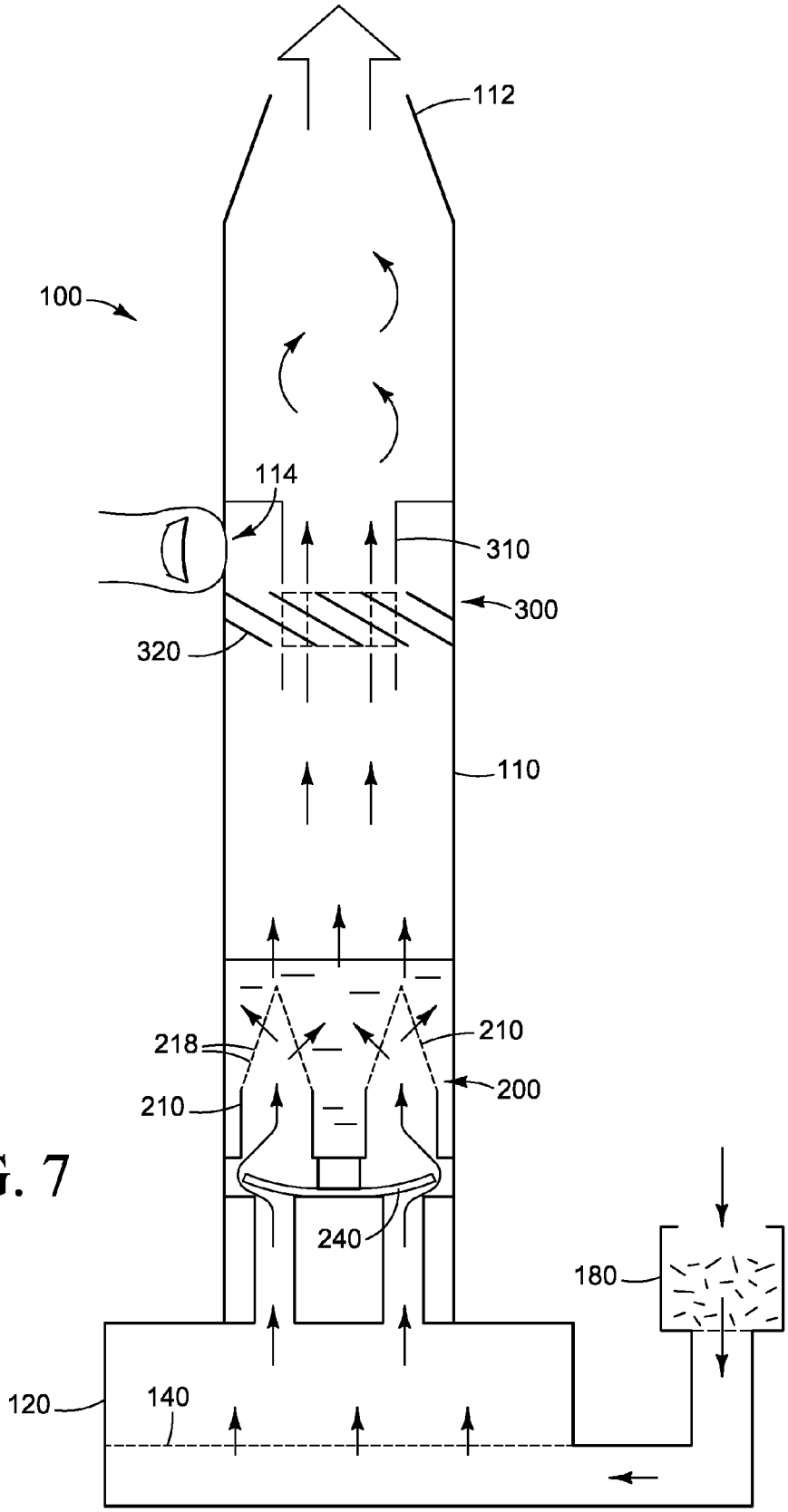
FIG. 7 is a schematic representation of a pipe within the present description showing airflow through the pipe in response to suction being applied by the user while the recirculation inlet hole is closed.

Having described the primary components, continue to refer to FIG. 4 with support from the exploded view of FIG. 6B for a description of the disclosed smoking appliance 100 during operation by a user. Prior to a smoking session, the user adds a small amount of water to the smoking appliance 100. Only enough water is used to fill the outer glass body tube 110 in the region extending vertically from the bottom of the cones 210 to their tops as can be seen in the schematic of FIG. 7. The diffusion cones 210 must have a sufficient wall thickness to withstand the pressure of the water, or other submersing liquid, so that the air inside the diffusion device 210 does not compress to such an extent that would allow the liquid to permeate to the interior of the diffusers 210.

The number of cones in the diffusion subassembly 200 and their characteristics, including their size, and the number and size of the holes in each cone, are established by flow requirements. The diffusion cones 210 act to disperse through a water medium the gas that is to be washed, which in this case is smoke. There are currently no known products, either industrial or consumer, that are based upon a cone-shaped diffusion device having a similar diameter and distribution of holes.

Not only does the conical shape of the diffusers 210 provide a large surface area over which to distribute holes, the shape is also important here as it serves to gradually and automatically adjust filtration rates to variations in draw pressure. This self-adjustment feature assists to produce consistent filtering results.

As the cones distribute the filtered gas to different levels, variations in exit velocities occur which tends to keep the filtered bubbles from joining together after being expelled from the nozzles. As rejoining of the bubbles is delayed the gas being dispersed experiences improved filtration due to the extended period of time over which the bubbles maintain their original volume. This effect is also responsible for the "foaming" behavior of the water pipe during operation. As the water foams, assuming a consistent inner diameter of the main chamber, the water column will approximately quadruple in height as air is drawn through the pipe, causing a significant increase in gas-water exposure time.

The cones 210 used in the presently described apparatus are specifically designed to adjust their flow-rate in response to variations of applied pressure, and more particularly to perform well at very low pressures, below 0.01 psi. In contrast to this, a typical fritter disc as might be used in a similar application will impede airflow to the extent of a pressure drop of 2-15 psi. This performance at low-pressure is accomplished by sizing the diffusion holes 218 to have a much larger diameter than those in a typical fritter disc. By virtue of the conical design of the diffusers 210, the number of holes 218 in these diffusers 210 increases as the cross-sectional diameter of the diffusers 210 increases.

When the diffusion cones 210 are submersed, the pressure of the surrounding water is counteracted by the reverse flow restriction of the series flapper valve 240. The flapper valve 240 in turn keeps water from entering the inside of the cones and seeping down into the base chamber 120. In addition to preventing the user from overfilling the water pipe 100, this combination of diffusion cones 210 and flapper valve 240 plays two important roles.

Firstly, by keeping the water from entering the cones 210, there is no need for the user to generate the large initial pressure gradient that would be necessary to draw water through the small diffusion holes 218. In consideration of the viscosity of water in comparison to that of air, much more force would be required to pull water through the holes than to draw air. To avoid this, water is initially kept from flowing to the interior of the diffusion cones 210.

Secondly, for use in tobacco applications, it is important to recognize that the tar by-products of tobacco smoke only exhibit major condensation at the boundaries where smoke and water meet. By keeping the water on the outside of the cones 210, the majority of the tar will condense on the outside instead of inside where it would clog the holes 218. This behavior significantly reduces the amount of cleaning required to keep the device operating properly.

The entire diffusion subassembly 200 is shown in the cutaway view of FIG. 4. For explanation of the individual components, refer to the exploded view in FIG. 6B. A cone divider 220 provides a support structure for a multiplicity of cones 210 while allowing an open path for flow of air through the center of each of the cones 210. Each cone 210 is mounted on a cone-to-core connector 214 having a hollow shaft. An O-ring 212 is used to provide a resilient mount between each diffusion cone 210 and its respective cone-to-core connector 214 that will withstand exposure to differential thermal expansions and mechanical shock. It is to be noted here that all O-rings in the preferred embodiment are made from white US FDA-approved Buna-N Nitrile and, unless otherwise specified, all have a durometer of 70 in the preferred embodiment.

The shafts of the cone-to-core connectors 214 are pressed to fit, or glued, into the cone divider 220 which establishes appropriate spacing for the multiplicity of cones 210. Another function of the cone divider 220 is to provide a structure for joining of the flapper valve 240 and its associated components to the cone-to-core connectors 214. A groove at the circumference of the cone divider 220 is fitted with O-ring 216 which will assist to seal the entire diffusion subassembly 200 within the cylindrical body tube 110. There is some advantage for O-ring 216 to have a durometer of 55, rather than 70 which is otherwise typical.

In the preferred embodiment the diffusion cones 210, cone-to-core connectors 214, and flapper valve retainer 230 are made of a suitable plastic polymer, such as polyoxymethylene or POM Acetal. The same material is used for the flapper valve frame 250 with its inner stepped sleeve which serves as a lower flapper retainer. The cone divider 220 is an alloy of aluminum, with type 6061 having properties that are particularly well-suited for the present application.

The flapper valve 240 must be pliable in order to minimize the pressure required for its proper operation while providing reliable one-way pressure regulation within the presently described system. In the preferred embodiment it is made of a thin elastomeric material. The flapper valve 240 is placed over the flapper valve support 244 and this combination is then set around a hollow pedestal 248 at the center of a flapper valve frame 250. The flapper valve frame 250 provides a valve seat against which the flapper valve 240 will seal when the fluid flow attempts to reverse. The primary function of the flapper valve support 244 is to provide support to prevent damage from excessive back pressure by keeping the flapper valve 240 from buckling and falling into the air cavity below it. Due to the material (316 Stainless Steel, US FDA Grade) from which it is constructed, the flapper valve support 244 also serves a secondary function as a filter screen.

A flapper retainer 230 is slipped onto the pedestal 248 to hold the flapper valve 240 in place, and to keep it from rising out of its seat in the presence of excessive forward flow which would occur in response to heavy suction. The cone divider 220 is placed atop the flapper subassembly separated by O-ring 222. O-ring 252 is then set into a relief at the underside of the flapper valve frame 250 and this combination is stacked atop the Tighten Frame 256. Capscrew 260, inserted into the underside of Tighten Frame 256, goes through the flapper valve frame 250 and threads into the underside of cone divider 220. As capscrew 260 is tightened to seat against the underside of the Tighten Frame 256 the entire diffusion subassembly 200 including cone divider 220 and flapper valve components are drawn snugly together.

The assembly of the core of the Smoking Appliance 100 detailed in the present description continues with the Base Chamber 120 whose components are shown in FIG. 6A with details of the fittings in FIG. 4. The first stage filter disc 140 is inserted into the underside of the Base Chamber 120 to remove particles that are physically too large to pass through subsequent filter stages. Bottom cap 144 is fitted with O-ring 142 about its perimeter and placed into the Base Chamber 120. A larger capscrew 148 is fitted with O-ring 146 and inserted through the bottom cap 120 and filter 140. A recess in the upper side of the Base Chamber 120 receives Tighten Ring 124. Another O-ring 126 is placed over the Tighten Ring 124 and the entire pre-assembled diffusion subassembly 200 is set above that. The base end 118 of outer body tube 110 is slipped over the diffusion subassembly 200 into the recess in the Chamber 120. As capscrew 148 is tightened into the underside of Tighten Frame 256, O-ring 126 is compressed to seal against the inner wall of the outer body tube 110 to hold it in place.

A Hollow Stem 184 is fitted with two O-rings 186 and 188 and inserted into Base Chamber 120. Fitting of a nickel-plated brass Combustion Bowl 180 into the open end of Hollow Stem 184 completes the assembly of the base components. The coating of the Combustion Bowl 180 serves as a thermal barrier and distributes the heat of the burning load while also preventing oxidation of the brass which would affect the flavor of the smoke. Those skilled in these arts will recognize other material coatings that may be useful in this application.

The flapper valve 240 restricts the flow of fluid, whether air or water, in one direction. Its use in the presently described apparatus is to keep water from flowing into the interior of the diffusion cones 210. The flapper valve 240 works in conjunction with the diffusion cones 210 to maintain a constant opposing pressure that resists the water as gravity tends to push it downward toward the interior of the cones 210. This pressure is counteracted by the restriction against the reverse flow that is provided by the flapper valve 240 arranged in series with the dispersion cones 210. Because of this opposite and equal pressure, an air-water barrier is maintained at some depth into the diffusion holes 218, with the penetration distance depending on the depth of component submersion. This is the primary reason for providing the walls of the cones 210 with some thickness, since a deeper submersion causes a deeper dispersion which results in greater penetration of the cone thereby requiring a thicker cone wall.

The thickness of the cone wall is critical for a variety of reasons. Thicker walls increase the surface area to which tars can adhere, requiring an increased shear force to expel the adhered tars. In contrast, a wall thickness that is small compared to the nozzle diameter causes the tar to be subjected to a bending and tearing force, which requires significantly less pressure to achieve satisfactory removal of the tar from within the holes. Thinner walls contribute significantly to reduce clogging. Even under extreme conditions, such as when very cold water is placed into the chamber causing tars of greater density to form earlier in the filtering process, accumulation of tar with in the holes of thin-walled cones may still be negligible. Thinner cone walls also allow water to penetrate to the interior of the cones which flushes the nozzles as air is drawn through them.

During a smoking session the water bath will remain on the outside of the cones. However, if the pipe is set aside for more than two hours or so without being drained, then some of the water may eventually leak into the base due to imperfections in the flapper valve. If this should occur, most or all of the water that leaked into the base will be drawn back up into the chamber when the pipe is again placed into service. This does not hinder the performance of the pipe at all, and may serve as an occasional flush of the cones to prevent clogs. An alternate embodiment may incorporate one or more small overflow reservoirs into the base to accommodate this drainage.

When a gas moves through a flapper valve, the slight disturbance in the flow allows the more dense components of the gas to fall out of the stream. As applied to the presently described system, this means that the liquidus type of tar will condense out of the smoke and be deposited on top of the upward facing surface of the flapper valve 240. This offers the advantage of increasing the amount of tar removed from the smoke.

Figure 9:
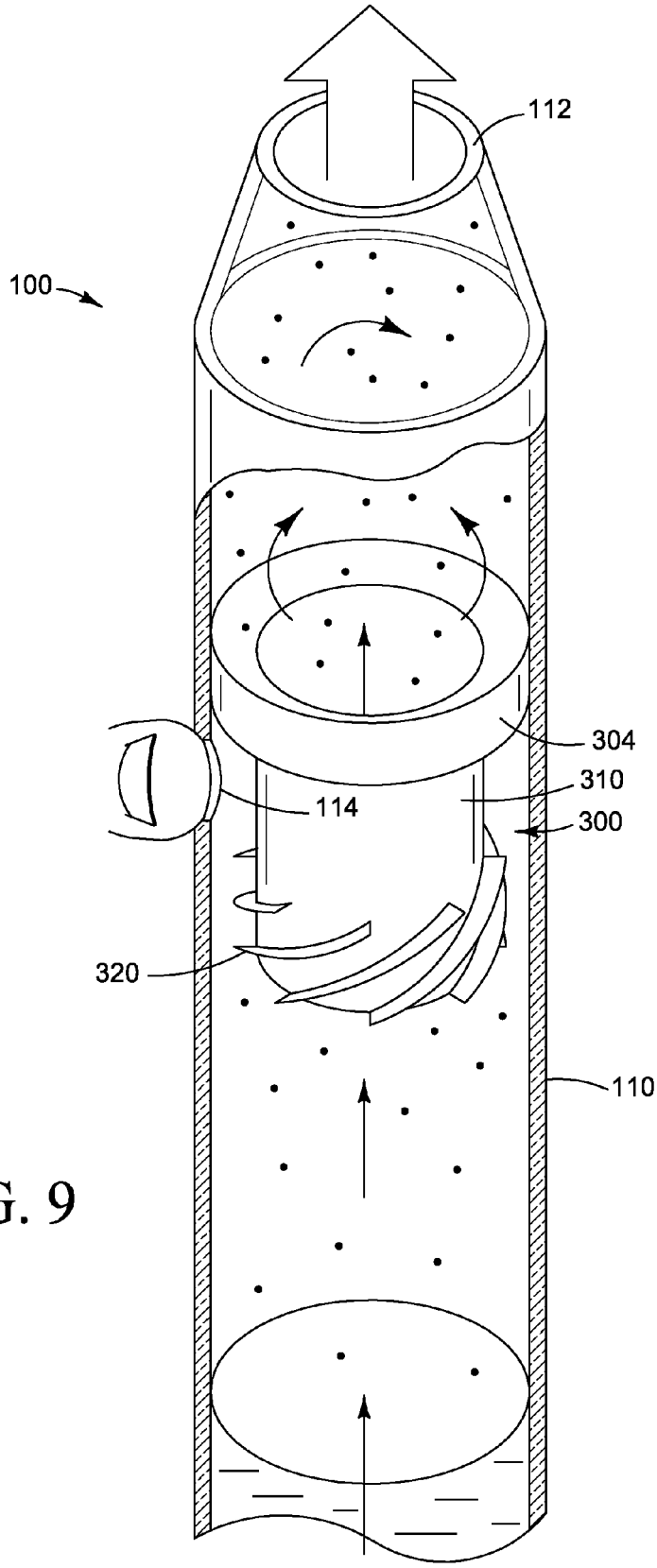
FIGS. 9-11 are a sequence of partial cutaway isometric views showing the airflow in response to action by a user.

For an understanding of the operation of the presently described smoking appliance, it will be useful to refer now to the schematic representation in FIG. 7 along with the partial cutaway view of FIG. 9. In preparation for a smoking session, a small amount of water is poured into the outer glass body tube 110 of the smoking appliance 100. Just enough water is used to fill the region containing the diffusion cones 210, from their flared lower edges to their tops as can be seen in the schematic of FIG. 7. At this point in an operation cycle, no other region will contain any water, all other interior spaces of the smoking appliance 100 will contain clean air.

An amount of smokable material is then placed into the combustion bowl 180 and ignited. The user places a finger over the hole at the recirculation inlet 114 to close it off and begins to apply suction at the mouthpiece 112 to draw air through the burning load. As the combustible load burns, the lower portion of the base 120 will fill with smoke. The first stage micro-perforated filter 140 will trap the larger ash particles before they are drawn into the primary diffusion subassembly 200. In the preferred embodiment of the appliance presently being described, this filter is a photo-chemically perforated piece of 316-type stainless steel with holes having a diameter on the order of 0.43 mm (0.017-inch).

In a short time, the region that includes the base 120 and the core interior below the flapper valve 240 will fill with smoke. With a lower pressure above the flapper valve 240 due to the applied suction, the valve will open to allow the smoke to fill the entire volume up to and including the interior of the diffusion cones 210. As discussed earlier, some amount of the liquidus tar will condense out of the smoke and be deposited on top of the upward facing surface of the flapper valve 240, amounting to a second stage in cleaning of the smoke.

With continued application of vacuum pressure to the mouthpiece 112, the smoke will be pulled through the diffusion cones 210. A third stage of the smoke cleaning occurs as the tar by-products condense out of the smoke at the boundary where the smoke and water meet. With a properly designed combination of flapper valve 240 and diffusion cones 210 water is kept to the outside of the cones so that most of the tar will condense in the water above the holes 218 rather than in them so as not to form a clog.

After the smoke is drawn through the water, it gradually accumulates to fill the central portion of the chamber above the surface of the water as can be seen in the partial cutaway view of FIG. 9. As the user continues to apply suction to the mouthpiece 112 while covering the recirculation inlet hole 114 to keep it closed, the smoke works its way upward towards the turbine subassembly 300. The chamber fills smoothly from bottom to top as the smoke displaces the clean air, stratifying in a denser-than-air manner. Once the smoke reaches the turbine subassembly 300 it is directed through the inner tube 310 (FIG. 6C) to the upper chamber where it is drawn out through the mouthpiece 112 into the mouth of the user.

Since the Upper Carburetor Nozzle 304 is sealed against the inner surface of the outer body tube 110 by O-ring 302 (FIG. 6C), as long as the recirculation inlet hole 114 (FIG. 7) remains closed there will be no pressure gradient in the region that extends downward from O-ring 302 to the lower rim (mouth) of the Carburetor Ring 322. At this point in the smoking session, the small volume of air between the inner tube 310 and the outer body tube 110 that is bounded by the region between Carburetor Ring 322 and O-ring 302 is the only volume that remains clear, containing no smoke.

Figure 8:
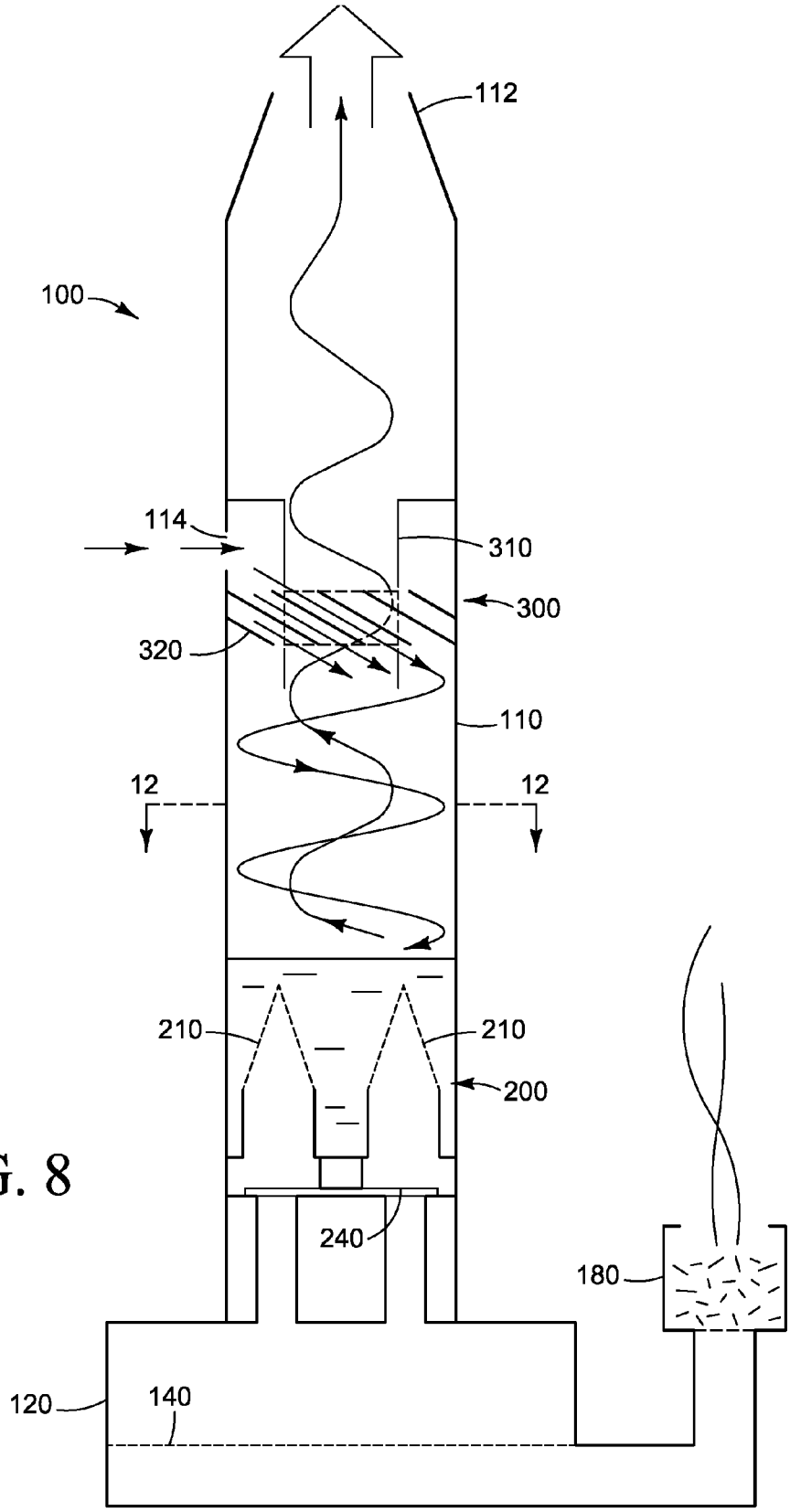
FIG. 8 is a schematic representation showing the airflow with an open air circulation inlet hole.
Figure 10:
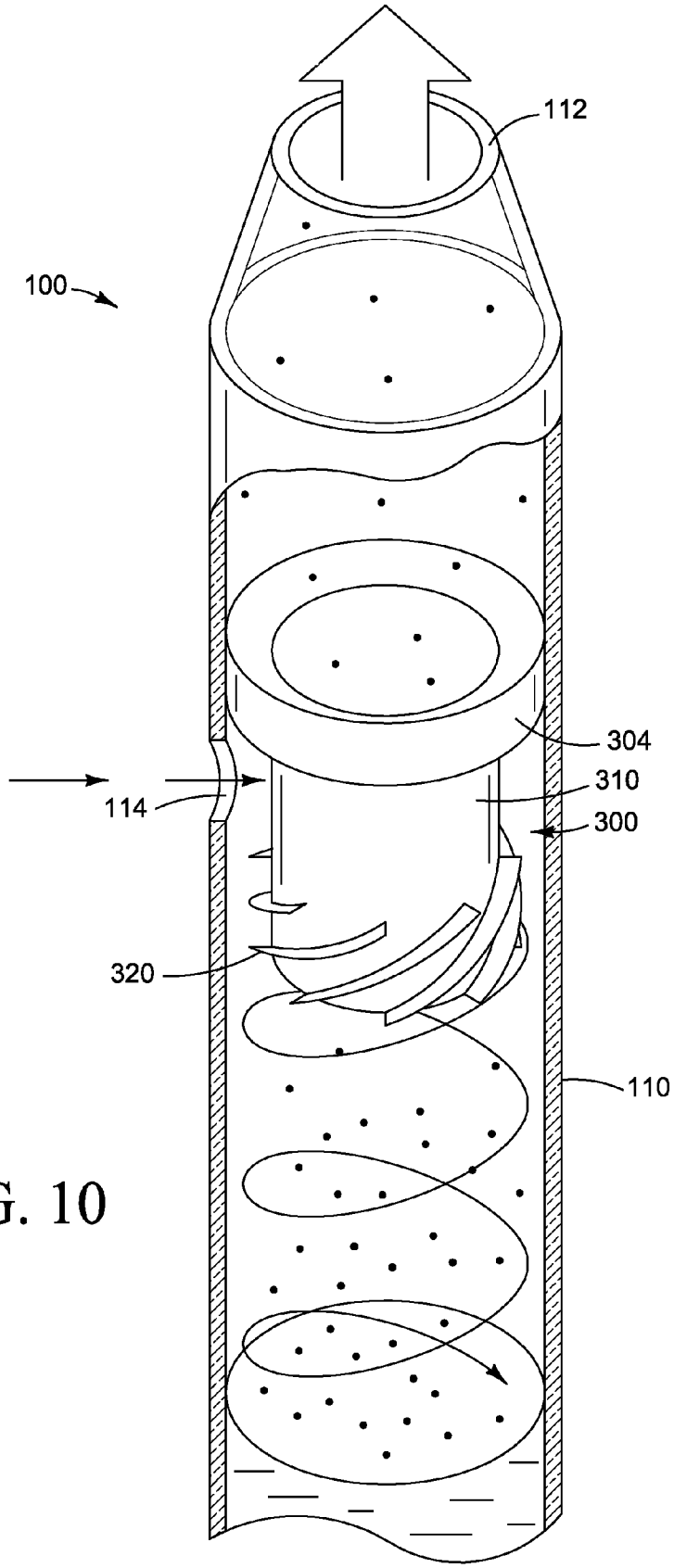

In the typical operation of a smoking session, when the smoke reaches the mouth of the user, the finger that is covering the recirculation inlet 114 will be removed. Referring to the schematic of FIG. 8 in conjunction with the partial cutaway view of FIG. 10, it can be seen that as the user continues to apply suction to the mouthpiece with an open recirculation inlet 114, the relatively lower pressure present inside the chamber will draw clean air inward through the recirculation inlet 114 and direct it downward through the spiral veins of the static turbine 320. This downward flow will receive some small convective assist due to the fact that the incoming air is cooler than the smoke-laden air within the pipe 100. Positioning of the recirculation inlet 114 for use in conjunction with the turbine subassembly 300 has a secondary benefit of allowing the user to introduce incoming air from an aesthetically pleasing location, without having to touch a hot combustion bowl.

Figure 11:
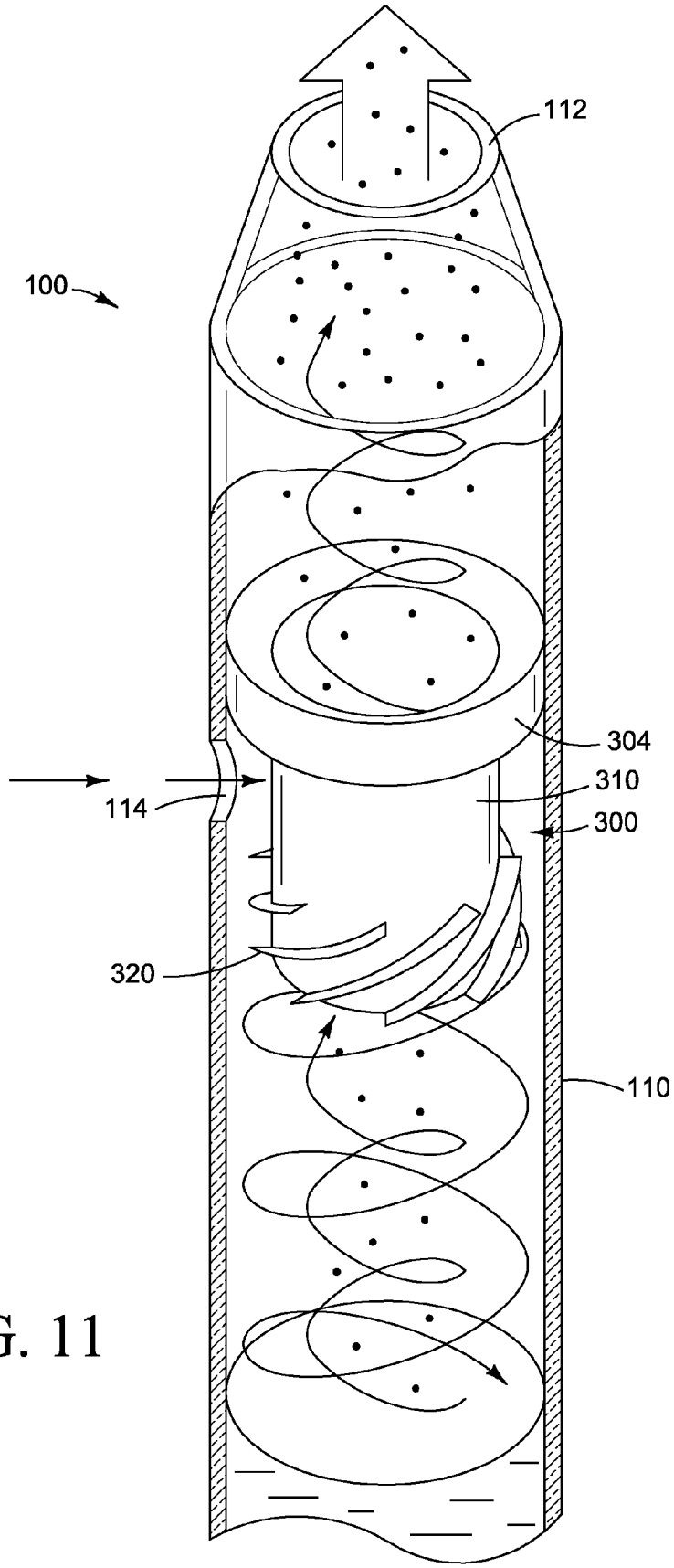

As the cooler incoming air is made to swirl downward a spinning hollow jacket of air is created that moves along the inside wall of the outer body tube 110 toward the water. The swirling motion maximizes the surface area of the exposure boundary between smoke and incoming atmospheric air assisting to quickly cool the smoke without diluting it, while the outer jacket of cool air has some additional cooling effect on the smoke-laden air which it surrounds. FIG. 11 shows the generation of the vortex which develops with a lower pressure at its center. The resultant centrifugal force expels heavier tar particulates from the swirling smoke toward the inner wall of the body tube 110 while keeping incoming air from diluting the smoke during the cooling process.

Figure 12:
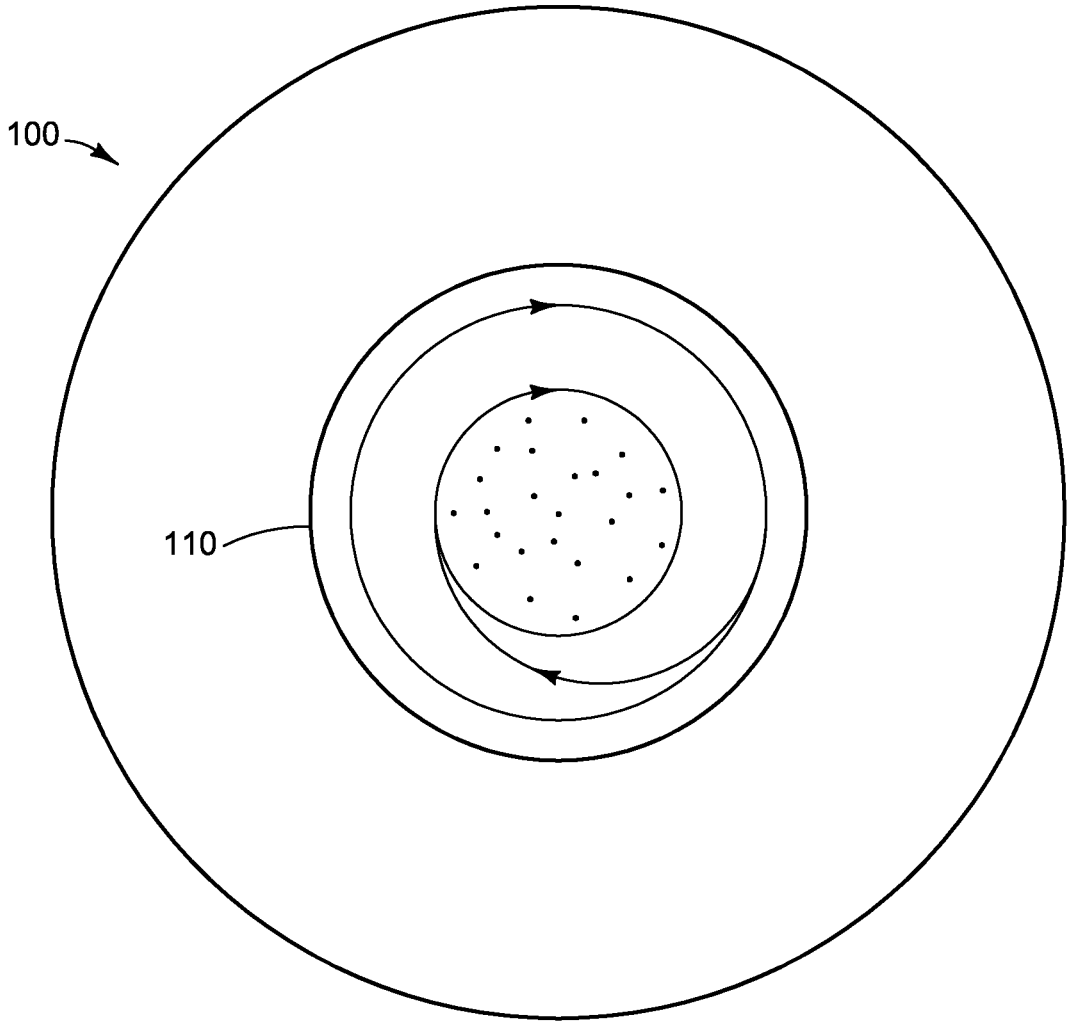
FIG. 12 is a section view taken along line 12-12 of FIG. 8 depicting the airflow as seen from the top of the pipe.

Furthermore, the spiraling downward air loses its vertical momentum as it encounters the water surface where it effectively ricochets back upward while maintaining its angular momentum as it is drawn to a smaller radius. This circular motion is depicted in FIG. 12 which has been taken along the section line 12-12 of FIG. 8. The overall effect of this helical fluidic motion is that the formerly stratified smoke-laden air will be compressed toward the center of the outer body tube 110 and drawn upward through the smaller diameter of the inner tube 310 of the turbine assembly 300 with a pressure-assisted velocity boost. The effect upon the user is that moving of the finger to unblock the recirculation inlet 114 results in the user's lungs receiving a sudden influx of smoke as it is driven out of the pipe 100 with little to no resistance internal to the pipe 100.

As pressures equalize within the pipe 100, the incoming cooler clean air will push the smoke upwards from the water-smoke boundary until the entire device, with the exception of the lower interior core area within the base chamber 120 is again filled with the clean air. With the user supplying continued suction to the mouthpiece 112, in a short while the system will stabilize to a condition similar to that which existed shortly after the smokable material was ignited.

Figure 13:
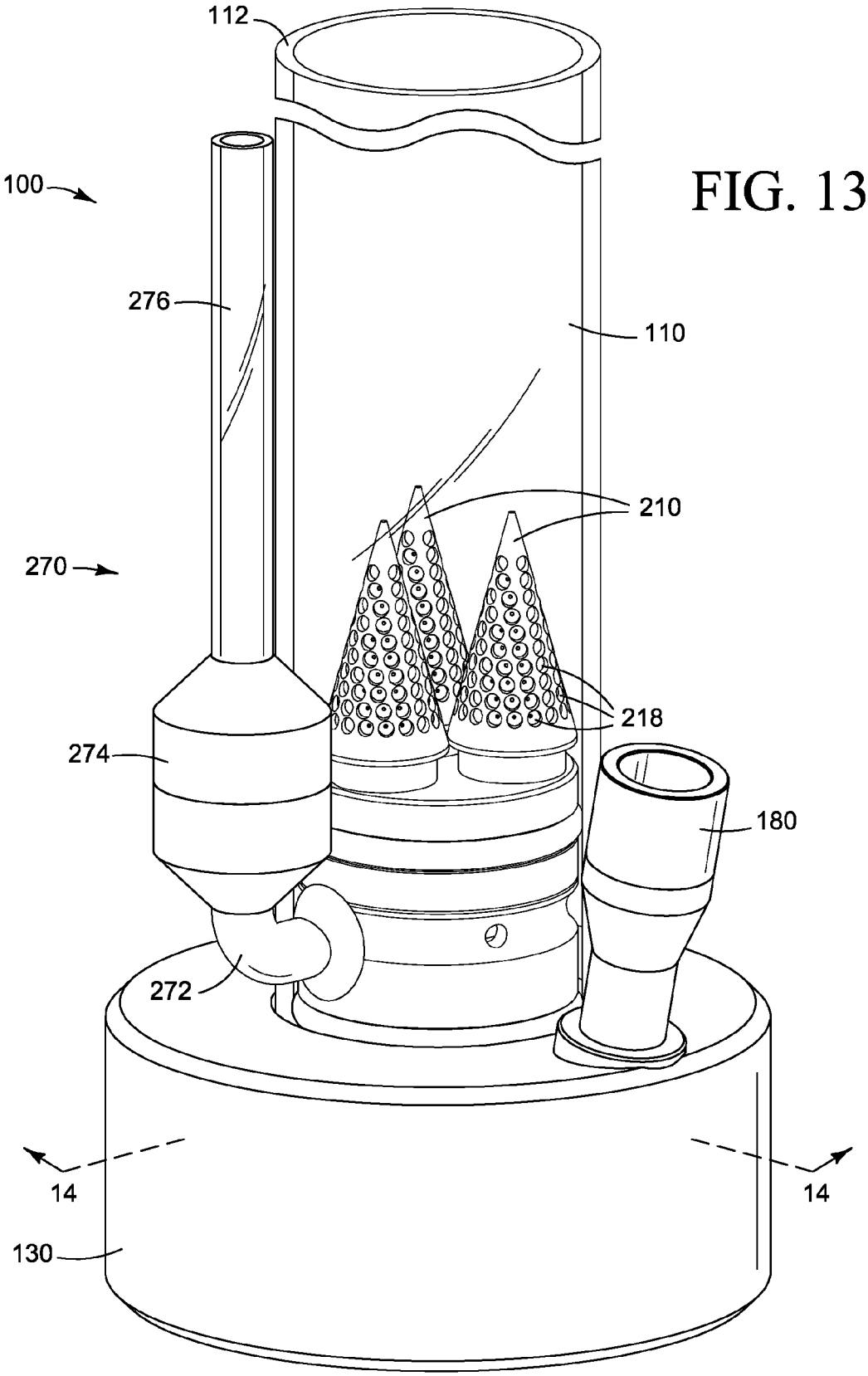
FIG. 13 is a perspective view showing a purge valve.
Figure 14:
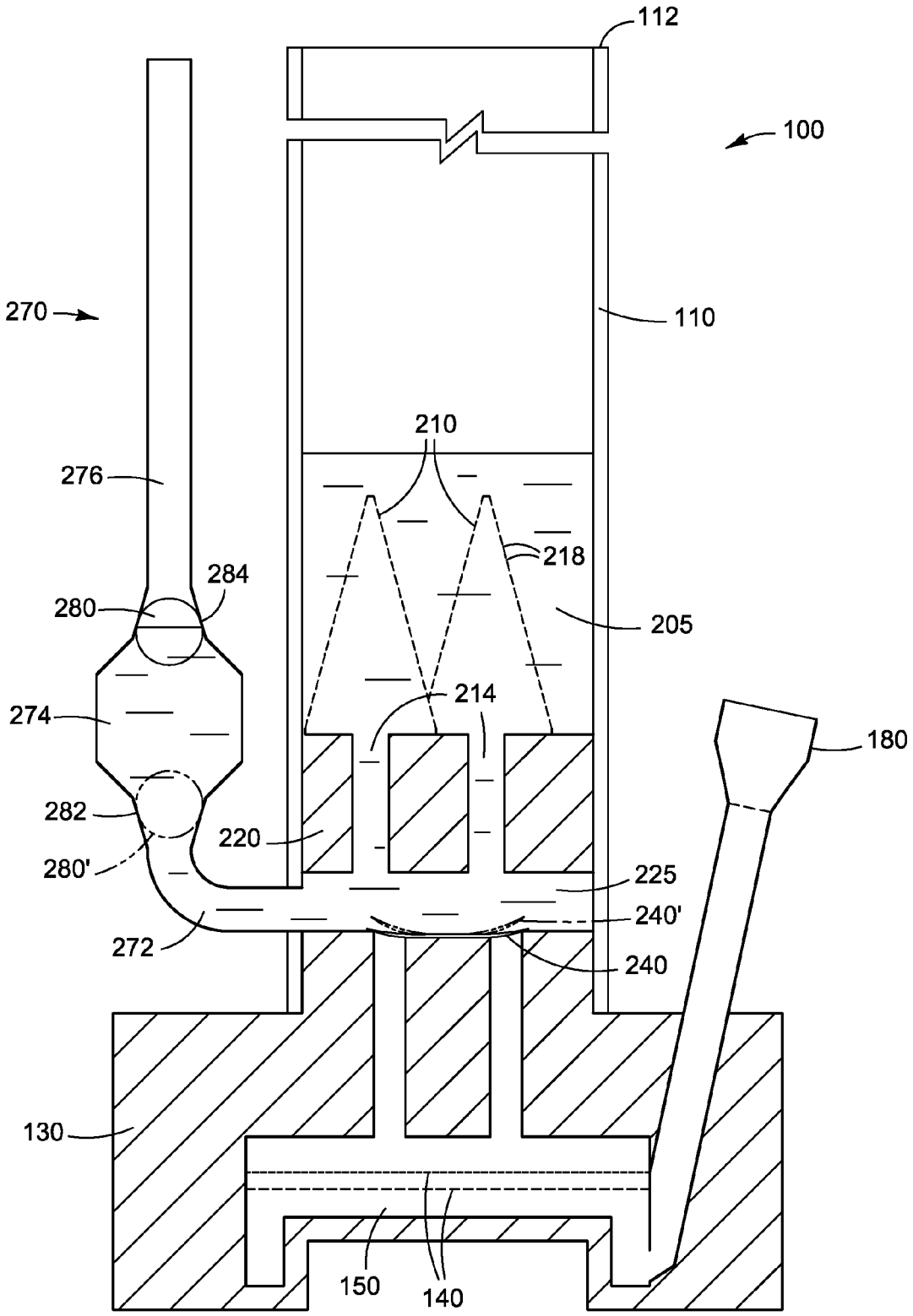
FIG. 14 is a schematic representation of apparatus incorporating a purge valve.

The above operation may be modified in part by the addition to the system of a Purge Valve subassembly 270 (FIG. 13). The Purge Valve subassembly 270 complements the performance of the flapper valve 240 by reducing the amount of time required for backwash of the diffusion subsystem each time the user relieves pressure after a draw at the mouthpiece 112. The schematic of FIG. 14 shows that a buoyant plastic ball 280 is enclosed within a valve body, or chamber, 274. The ball achieves its buoyancy by virtue of being hollow. The interior of the chamber 274 is formed with a tapered seat at each end, a lower tapered seat 282 and an upper seat 284. Although described as tapered seats (282 and 284), those skilled in such art will recognize advantages to seats that are shaped other than tapered, for example, the seats may be radiused. The lower end of the body 274 is connected through a purge valve inlet tube 272 to the pressurized side of the chamber containing the flapper valve 240, while the upper end of the body 274 is open to the atmosphere outside of the tube 110 through a snorkel 276, or exhaust tube.

Before starting a smoking session the diffusion chamber 205 will be filled with water to cover the diffusion cones 210 until equilibrium is reached. This occurs as the water bath seeps through the diffusion cones and down into the distribution chamber 225 where water pressure keeps flapper valve 240 in the closed position. Thus sealed, the distribution chamber 225 fills and water rises into the purge valve body 274 causing the buoyant plastic ball 280 to float until it reaches the upper seat 284 where it seals the opening to the snorkel 276, preventing escape of water into the exhaust tube.

As the user draws vacuum pressure at the mouthpiece 112, the purge assembly 270 empties of water and gravity causes the ball 280 to drop into the lower tapered seat 282 where it becomes lodged at the bottom of the chamber 274. Continued negative pressure causes the flapper valve to open to position 240' allowing smoke to be drawn from the filter chamber 150 through the filters 140. The smoke continues to fill the distribution chamber 225 and then passes through the diffusion cones 210 into the water bath in the diffusion chamber 205 where it is cleaned and cooled before passing upward through the tube 110 to the user's mouth.

As the user ceases to inhale, the pressure interior to the tube 110 equalizes toward the atmospheric pressure at the mouthpiece 112 causing the pressure gradient across the purge chamber 274 to invert. This change in pressure allows water to rush down through the diffusion cones 210, then through the inlet tube 272 into the bottom of the purge valve chamber 274. This reverse flow causes the ball 280 to be forced out of the lower tapered seat 282. The ball 280 then is carried by motion of the incoming water and floats up toward the upper tapered seat 284 into which it is pressed, sealing against the seat 284 to disrupt the flow of water into the chamber 274.

When the user again applies a vacuum to the mouthpiece 112, water that has accumulated in the purge valve chamber 274 is drawn back out into the main tube 110 until the ball 280 again drops against the lower seat 282. With the purge valve 280 thus effectively stoppered, the vacuum is diverted to draw smoke through the flapper valve 240. This washing, or flushing, motion serves the overall smoking appliance 100 as a self-cleaning feature.

Figure 6D:
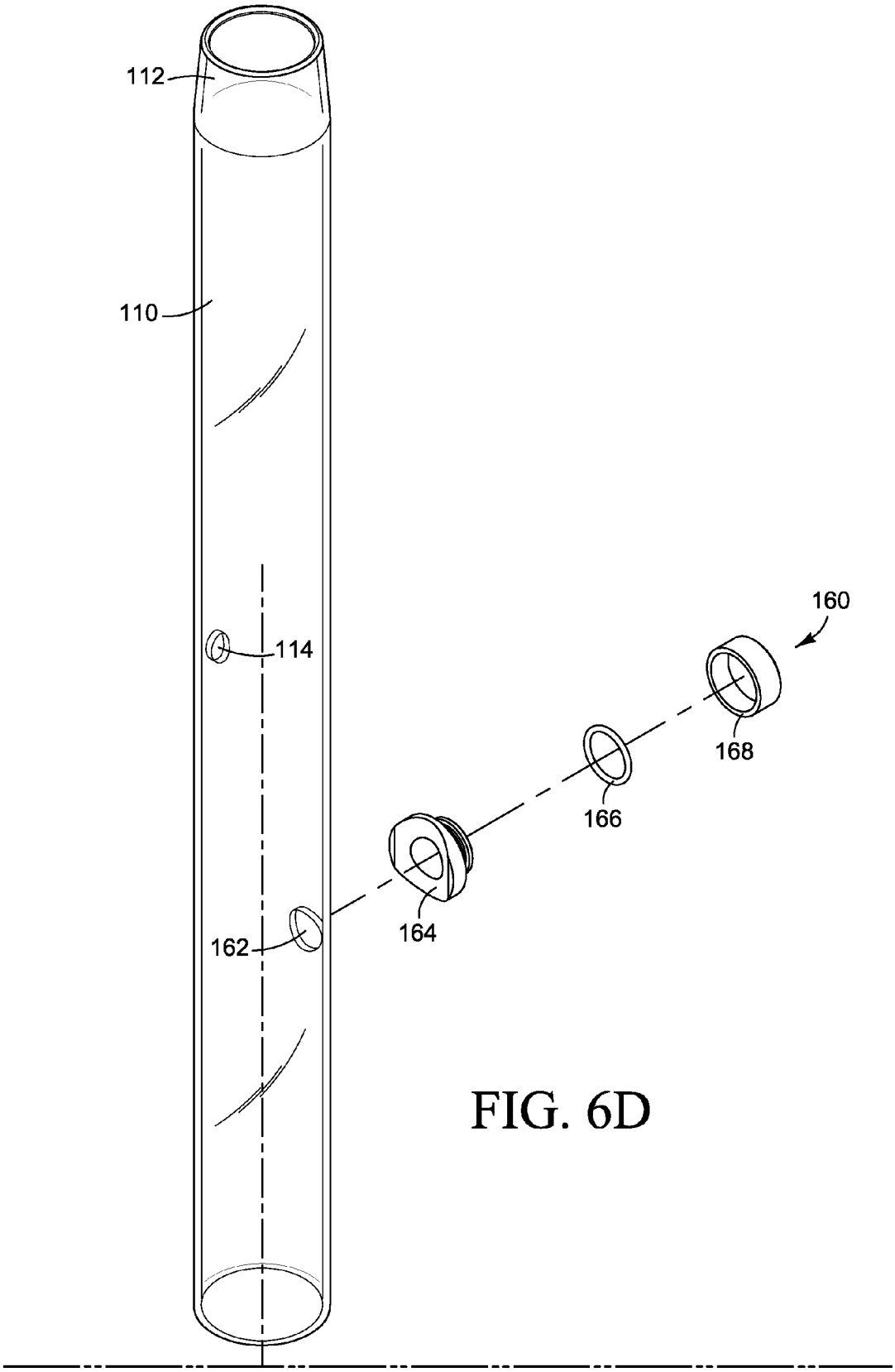

At the end of a smoking session, it is important that the pipe 100 be cleaned. Referring to FIG. 6D, the cleaning operation is facilitated by the drain subassembly 160. This subassembly includes a drain hole 162 in the side of the outer body tube 110 which has been fitted with a drain body 164 and O-ring 166. During a smoking session a drain cap 168 is used to cover the drain body 164 to maintain an airtight seal.

Figure 17:
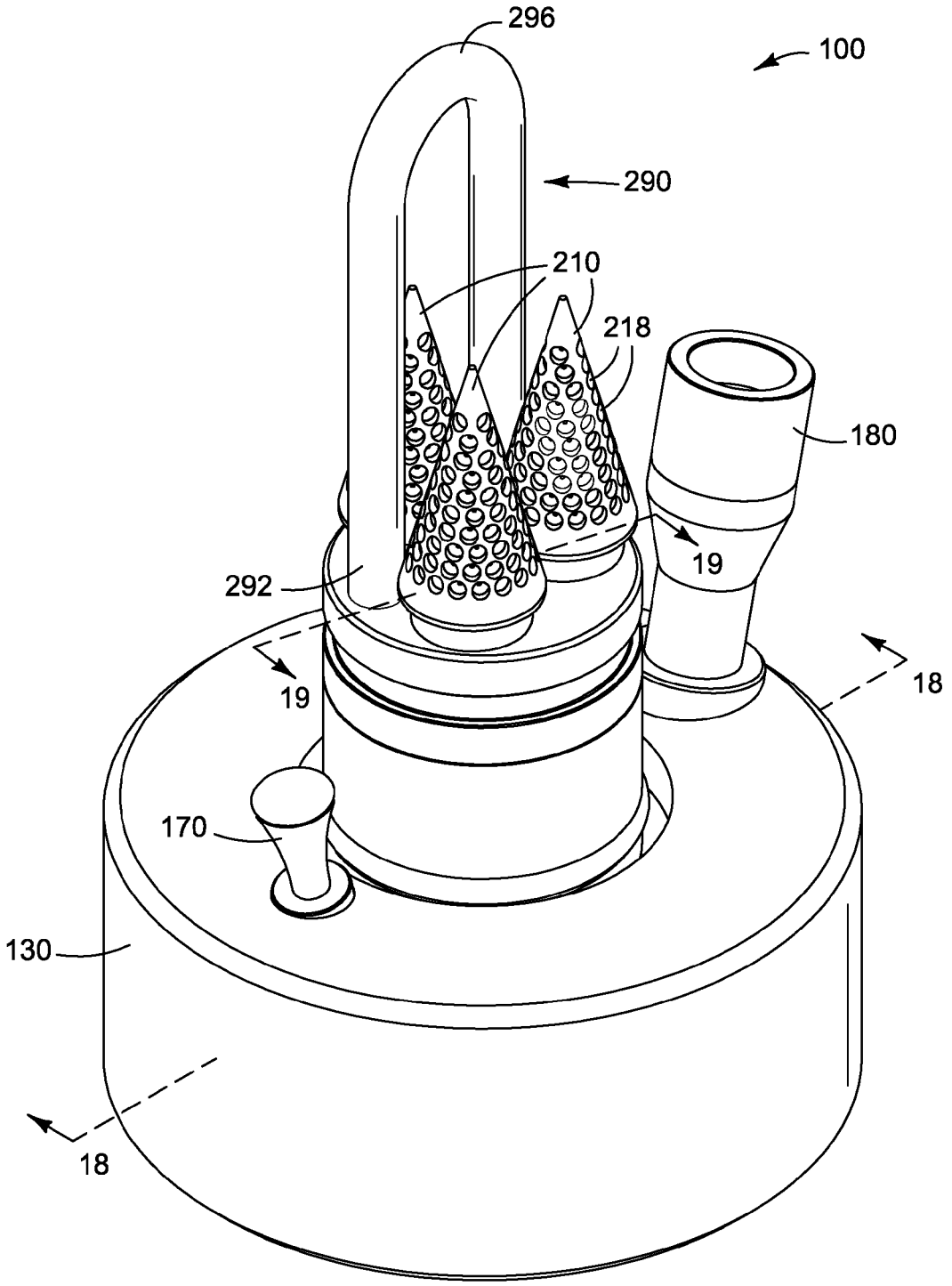
FIG. 17 shows a perspective view of an apparatus using a water column as a valve.

Additional cleaning of filters and diffusers is facilitated by Clean-out plug 170 shown in FIG. 17. Removal of the plug allows the user to force water through the hole into the filter chamber 150 for backwashing of the filters 140. At the same time water is forced into the distribution chamber 225 to flush the diffusion cones 210. This process provides a quick and effective means of cleaning the smoking apparatus 100 without requiring any disassembly.

When it is time to empty the water pipe of its water bath at the end of a smoking session, the user will remove the drain cap 168 and gently tip the pipe 100 so as to direct the contaminated water through the drain hole 162 into an appropriate disposal basin. Since the used water bath is likely to contain solid matter, it is desirable that the water pipe 100 be drained in this manner so as to avoid contamination of the turbine subassembly 300, though this is more a matter of maintaining an attractive appearance than it is an operational consideration. The position of the drain subassembly is such that the water pipe 100 may be filled in the basins of most lavatories.

Having described in some detail the features of the preferred embodiment, it will be recognized by those skilled in the associated arts that the function of each of the subassemblies may be accomplished by alternate constructions. As a first example, consider the diffusion subassembly 200, the function of which is to disperse tobacco smoke through a water medium while avoiding clogging of the diffusers. This function requires that both of the sub-functions of the flapper valve 240 and the diffuser must be present. However, these may be accomplished in manners other than those described in reference to the preferred embodiment.

Figure 15:
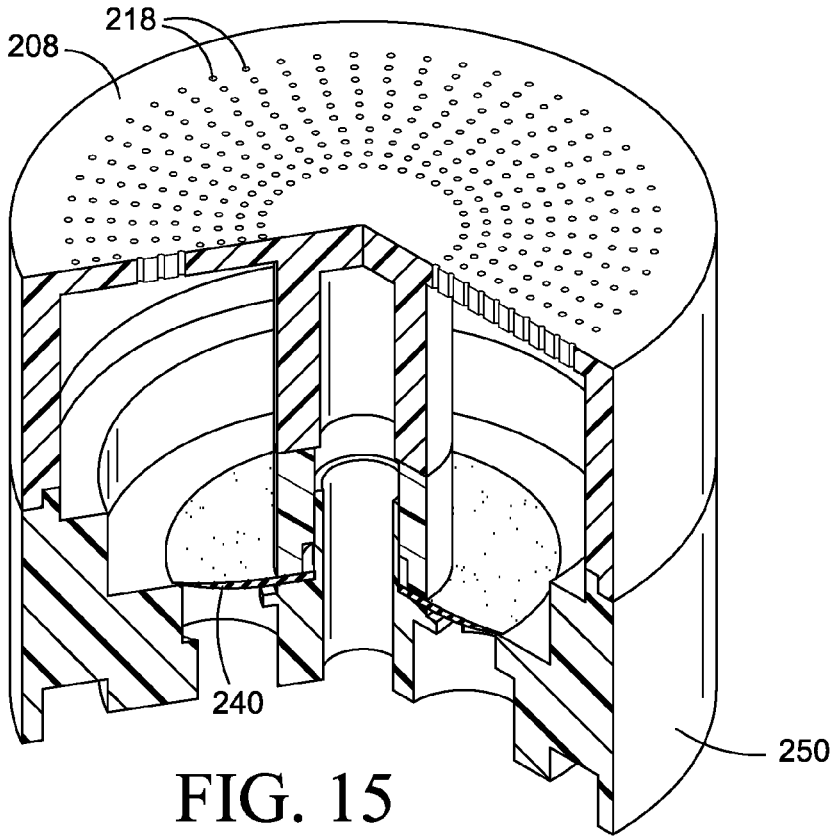
FIG. 15 represents in a cutaway view an alternate embodiment of the base chamber with a flat diffusion screen.

For a brief discussion of one alternate embodiment of the diffusion subassembly 200, refer to FIG. 15. Here, the multiple diffusion cones 210 of the preferred embodiment have been replaced with a solid one-part flat diffusion matrix 208. The diffusion holes 218 in this alternate embodiment point directly upward toward the surface of the water instead of outward as in the earlier described cone-style distributor.

A further alteration (not shown) takes a single diffusion cone and relocates the flapper valve within that cone, above any cone-to-core connector. Yet another alternate embodiment uses multiple instances of cones each containing its own flapper valve. In such an embodiment each cone is mounted on its own cone-to-core connector (similar to 214) and the multiplicity of cone-to-core connectors is then supported by a single cone divider (similar to 220). These alternate embodiments offer the advantage of being able to handle higher back pressure due to the decreased volume of air that is compressed beneath the cones.

Figure 16:
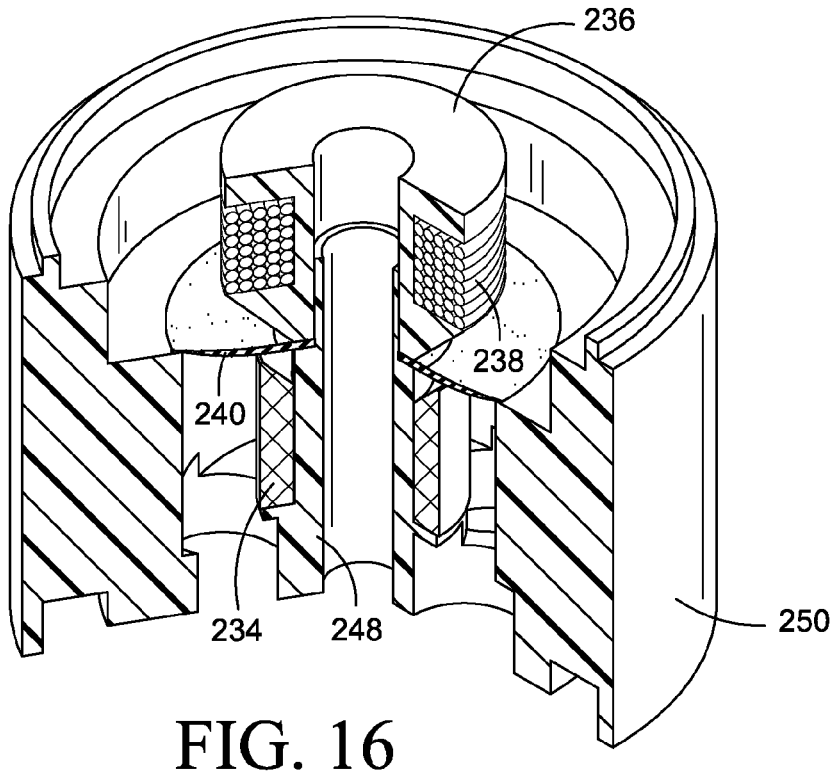
FIG. 16 shows a cutaway view of an alternate embodiment of the base chamber using an electromagnetically-assisted flapper valve.

Yet another alternate embodiment addresses the flapper valve. The implementation of FIG. 16 increases the efficiency of the diffusion system by reducing the amount of pressure required of the user to draw air through the diffusers. This is accomplished by an electromagnetic assist mechanism. A fixed-position electromagnetic coil 238 is supported by an electromagnetic core 236. A movable linear-motion sliding ceramic-coated magnet 234 is located on the opposite (lower) side of the flapper valve 240. When activated, the electromagnetic coil 238 assists to move the flapper valve 240. The electric current to operate the electromagnetic coil 238 may be produced by a power source and controlled by a sensor mounted in the vacuum area. The sensor detects the pressure gradient and the amount of current supplied to the coil is adjusted as a function of that differential. In this embodiment the pressure necessary to operate the flapper valve can be tuned as the lifting force of the magnet is used to cancel the downward force of the flapper which results in minimal overall pressure required to operate the entire device. For purposes of clarity the sectioned electromagnetic coil 238 of FIG. 16 is not hatched.

Figure 18:
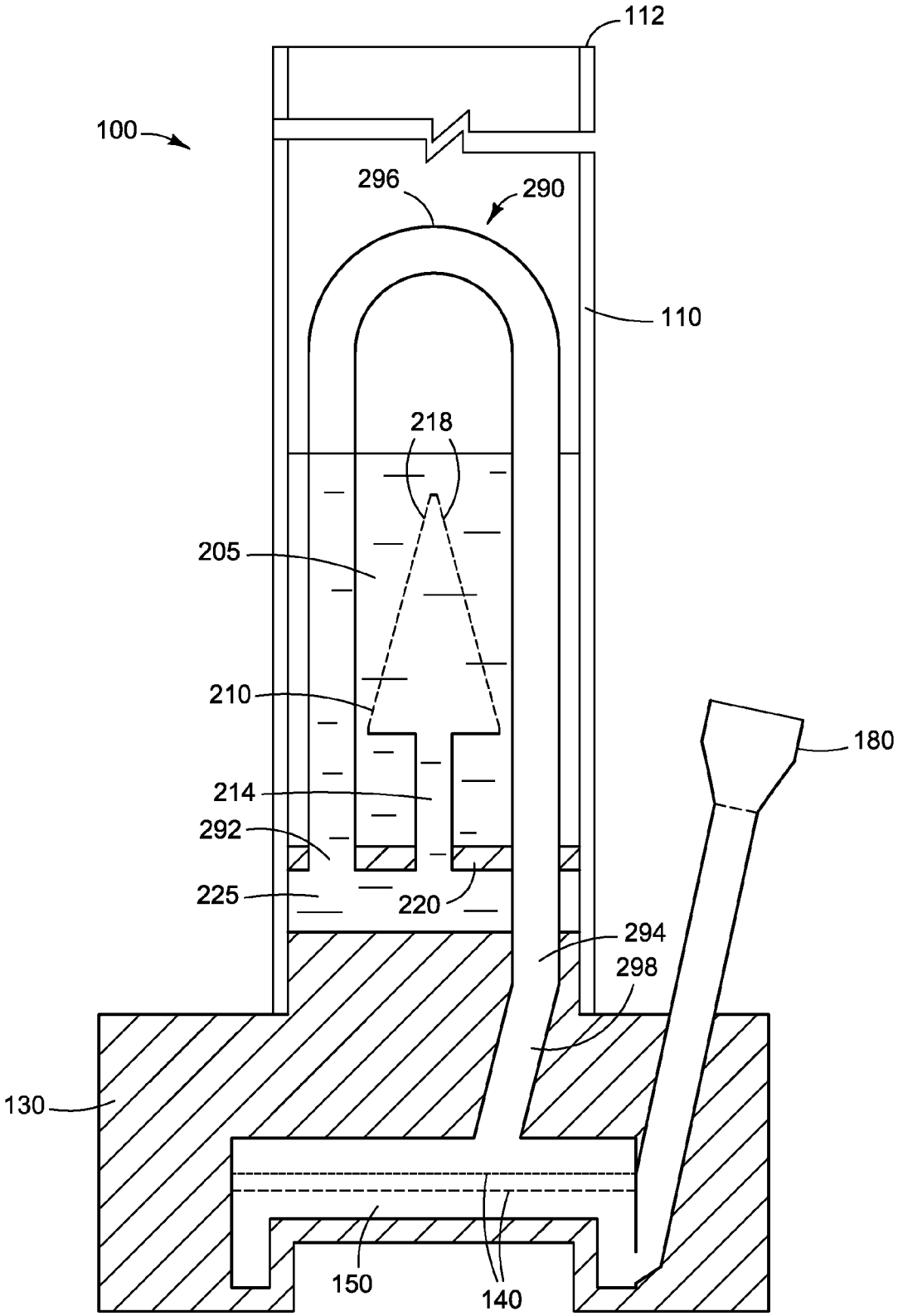
FIG. 18 is a schematic of an apparatus to show the action of a water column.

Unlike the Purge Valve subassembly 270 which assisted in the operation of the flapper valve 240, a Water Column subassembly 290 may be used as a substitute to replace the flapper valve 240 completely. As shown in the perspective view of FIG. 17 and depicted schematically in FIG. 18, an inverted a U-shaped tube 290 is placed into the diffusion chamber 205 which surrounds the outside of the diffusion cones 210. A higher end 292 of the water column tube 290 forms a watertight connection to the distribution chamber 225 at the underside of the diffusion cones 210 and the manifold that supports them. A lower end 294 of the water column tube 290 extends through the distribution chamber 225 and fits into channel 298 which connects to the filter chamber 150.

Prior to use, the diffusion chamber 205 is filled with sufficient water to cover the diffusion cones 210. The water seeps through the diffusion cones 210 into the distribution chamber 225 and enters the higher end 292 of the water column tube 290 until equilibrium is reached at which point the water level inside the water column matches the level of the water bath in the surrounding diffusion chamber 205 outside. If the diffusion chamber 205 is overfilled, the water level will reach the midsection 296 of the water column tube 290 and will drain down through the lower end 294 of the water column tube 290 into the filter chamber 150 from which it will need to be drained.

When the diffusion chamber 205 is properly filled to cover the diffusion cones 210 without overfilling, the pipe 100 is ready for the user to apply suction to the mouthpiece 112. Negative pressure in the tube 110 draws the water bath slightly upward within the tube 110 which in turn draws smoke out of the filter chamber 150 and through the entire length of the water column tube 290 until the distribution chamber 225 is completely filled with smoke. As the user continues to draw, smoke is pulled through the diffusion cones 210, is cleansed and cooled by the water bath upward through the tube 110 as with other embodiments.

When the user ceases to draw vacuum pressure, the water bath within the diffusion chamber 205 drops under the influence of gravity and seeps through the diffusers 210 until the distribution chamber 225 is completely filled with water which then rises into the upper end 292 of the water column 290 until it again reaches equilibrium at the same elevation of the water contained in the main chamber 110. This cycle produces a mild flushing action following each draw by a user. Over an extended life of a smoking apparatus 100, the use of a water column subassembly 290 offers an advantage in reliability over the flapper valve 240 due to its lack of moving parts.

As mentioned above in the discussion of the general assembly of the pipe in FIGS. 4 and 6B, the thickness of the wall of the diffusion cones 210 is critical. When a water column 290 is used, thicker walls become desirable in order to withstand the extra pressure of water washing back and forth through the perforated surface. However, as discussed earlier, thicker walls increase the surface area to which tars can adhere, requiring an increased shear force to expel the adhered tars, whereas thinner walls tend to reduce clogging. This is especially true when the wall thickness is small compared to the nozzle diameter which subjects accumulated tar to bending and tearing forces, enabling removal of the tar from within the holes with less pressure.

Figure 19:
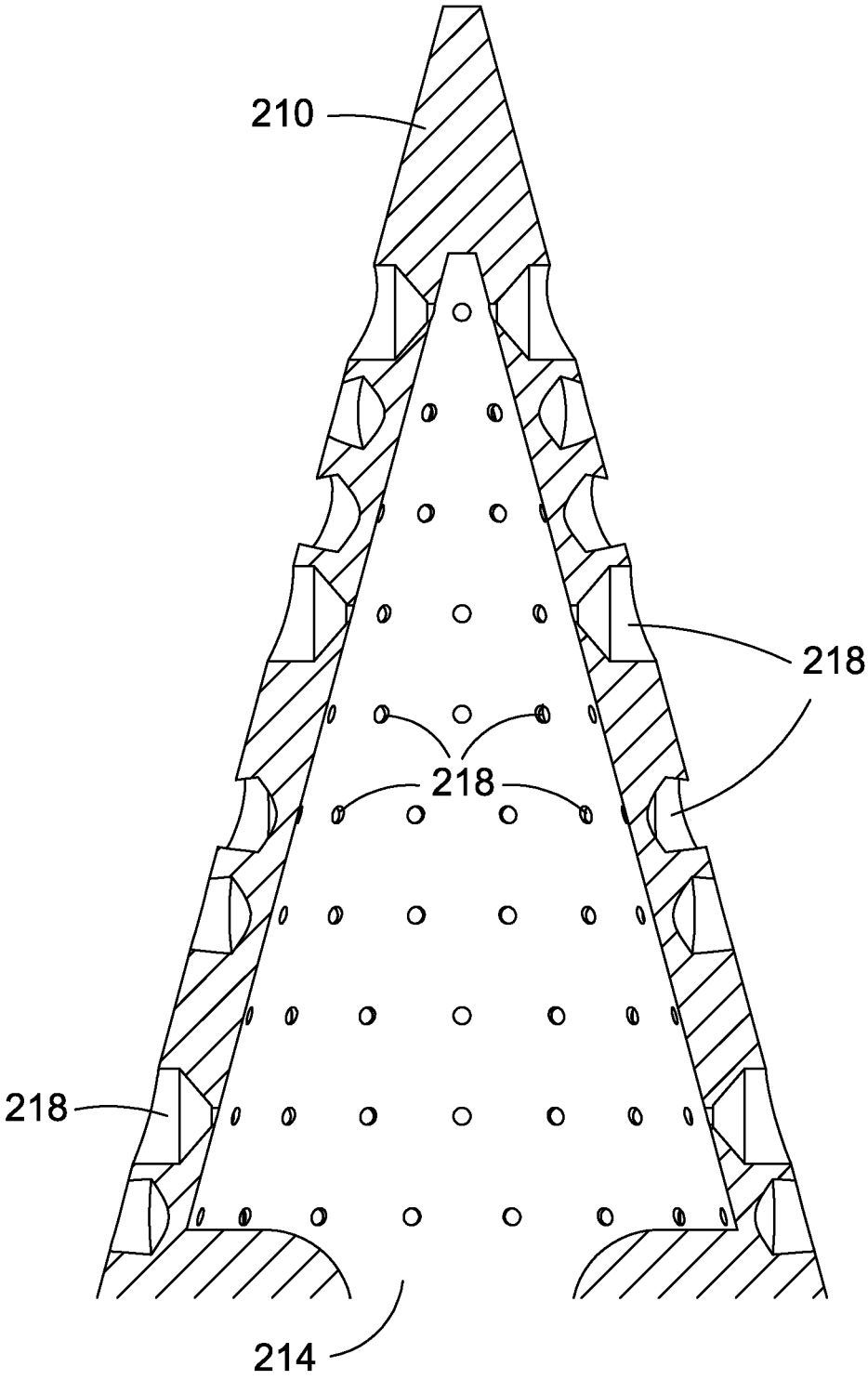
FIG. 19 shows a section view of nozzles within a diffusion cone.

One solution to this seeming paradox is shown in the close-up cutaway view of the diffuser cones 210 in FIG. 19. Here it can be seen that the outward facing counterbore of each hole throughout the multiplicity of holes has a diameter that is large relative to the diameter of the hole at the inner surface of the diffusion cone. The relatively thick wall of the diffusion cone 210 holds up well against higher pressures. At the same time the counterbored holes present a relatively thin wall at the inner surface of the diffusion cone 210 to enable the bending and tearing action that discourages the accumulation of tar within the holes and enables cleaning at lower pressures.

Although the presently disclosed apparatus has been described as a water pipe for the cleaning of tobacco smoke, it will be recognized by those skilled in the related arts that the described method has other applications in other industries. The method is especially useful for the washing of gases where the gas flow is not constant, or may even be intermittent, cycling on and off. The method is also applicable to the washing of gases that contain heavy condensates such as airborne tar particulates. Furthermore, the presently described method is useful for gases that may react with the liquid medium used in the bath where it is specifically preferred that the reaction take place outside of the diffusion device.

It will be obvious to those having skill in the art that changes may be made to the details of the above-described embodiments without departing from the underlying principles of the invention. The scope of the present disclosure should, therefore, be determined only by the following claims.

What is claimed is:

1. A smoking apparatus comprising:

a base chamber;

a combustion bowl for containing combustible smokable material, the combustion bowl connected in an airtight manner to said base chamber;

a body tube connected at a lower end in an air-tight manner to said base chamber to receive smoke from the combustion bowl, said body tube having at an upper end, opposite the lower end, an open mouthpiece from which a user draws smoke after the smoke has been filtered and cooled;

a filter subassembly fitted within a lower portion of said body tube in proximity to said base chamber;

a one-way valve in series with the filter subassembly, the one-way valve biased to be normally closed and to open in response to application of a negative pressure at the mouthpiece; and a diffusion subassembly comprising one or more diffusers at least partially covered with a water bath, which diffusers diffuse smoke into the water bath after application of the negative pressure has drawn the smoke through the one-way valve, wherein the one-way valve comprises a water column, wherein the water column is topologically equivalent to an inverted U-shaped tube, a first open end of the water column extends into said base chamber to receive accumulated filtered smoke, a second open end of the water column fluidically connects to deliver filtered smoke received at the first open end to an input of the diffusion subassembly during application of the negative pressure at the mouthpiece, the second open end terminating at a level that is lower than the water bath, and a region of the water column between the first open end and the second open end is entirely above an uppermost level of the water bath, and wherein upon removal of the negative pressure at the mouthpiece, a portion of the water bath covering the diffusion subassembly drains as backwash into the diffusers and is forced by atmospheric pressure into the second open end of the water column until an equilibrium is reached between a level of the water bath inside the water column and a level of the water bath outside the water column.

2. A smoking apparatus comprising:

a base chamber;

a combustion bowl for containing combustible smokable material, the combustion bowl connected in an airtight manner to said base chamber;

a body tube connected at a lower end in an air-tight manner to said base chamber to receive smoke from the combustion bowl, said body tube having at an upper end, opposite the lower end, an open mouthpiece from which a user draws smoke after the smoke has been filtered and cooled;

a filter subassembly fitted within a lower portion of said body tube in proximity to said base chamber;

a one-way valve in series with the filter subassembly, the one-way valve biased to be normally closed and to open in response to application of a negative pressure at the mouthpiece; and a diffusion subassembly comprising one or more diffusion cones, each diffusion cone being perforated by a multiplicity of holes, and each diffusion cone being at least partially covered with a water bath, which diffusion cones diffuse smoke into the water bath after application of the negative pressure has drawn the smoke through the one-way valve.

3. The smoking apparatus of claim 2 wherein the one-way valve comprises a flapper.

4. The smoking apparatus of claim 2 wherein each of the multiplicity of holes has an outward facing counterbore that has a diameter that is large relative to the diameter of each of the multiplicity of holes at an inner surface of the diffusion cone.

5. A smoking apparatus comprising:

a base chamber;

a combustion bowl for containing combustible smokable material, the combustion bowl connected in an airtight manner to said base chamber;

a body tube connected at a lower end in an air-tight manner to said base chamber to receive smoke from the combustion bowl, said body tube having at an upper end, opposite the lower end, an open mouthpiece from which a user draws smoke after the smoke has been filtered and cooled;

a filter subassembly fitted within a lower portion of said body tube in proximity to said base chamber;

a one-way valve in series with the filter subassembly, the one-way valve biased to be normally closed and to open in response to application of a negative pressure at the mouthpiece;

a diffusion subassembly comprising one or more diffusers at least partially covered with a water bath, which diffusers diffuse smoke into the water bath after application of the negative pressure has drawn the smoke through the one-way valve; and a static turbine subassembly fitted axially within a central portion of said body tube between the diffusion subassembly and the mouthpiece, wherein the static turbine subassembly comprises, a static turbine surrounded at its perimeter by spiral-shaped blades, the static turbine seated on a lower carburetor ring, and an inner tube of smaller diameter than the static turbine is fitted with a flared upper carburetor nozzle, the inner tube is set atop the static turbine, and the flared upper carburetor nozzle is sealed against an inner surface of the body tube.

6. The smoking apparatus of claim 5, further comprising:

a recirculation inlet, wherein the recirculation inlet is an aperture in said body tube located proximal to the inner tube between the static turbine and the upper carburetor nozzle, and the recirculation inlet has a size that is coverable by a finger tip of a user.

7. The smoking apparatus of claim 5 wherein the one-way valve comprises a flapper.

* * * * *